United States Patent [19]

Westeren et al.

[11] 4,118,016

[45] Oct. 3, 1978

[54] CONTINUOUS HEAT TREATING VACUUM FURNACE

[75] Inventors: Herbert W. Westeren, Barrington; Ronald A. Harrison, Cranston, both of R.I.

[73] Assignee: C.I. Hayes Inc., Cranston, R.I.

[21] Appl. No.: 731,504

[22] Filed: Oct. 12, 1976

[51] Int. Cl.[2] ..... C21D 1/74

[52] U.S. Cl. ..... 266/130; 74/501 R; 49/253; 266/250

[58] Field of Search ..... 49/199, 204, 253, 340; 74/501 R; 266/130, 250

[56] References Cited

U.S. PATENT DOCUMENTS

| | | | |
|---|---|---|---|
| 2,230,783 | 2/1941 | Parsons et al. | 49/253 |
| 2,856,181 | 10/1958 | Fenton | 49/253 |
| 3,266,644 | 8/1966 | Ipsen | 266/250 X |
| 3,659,831 | 5/1972 | Reber et al. | 266/250 X |
| 3,718,324 | 2/1973 | Westeren et al. | 266/250 |
| 3,782,705 | 1/1974 | Westeren et al. | 266/250 X |
| 3,838,607 | 10/1974 | Hemens | 74/501 R X |

FOREIGN PATENT DOCUMENTS

| | | | |
|---|---|---|---|
| 2,255,386 | 5/1974 | Fed. Rep. of Germany | 49/199 |

*Primary Examiner*—Roy Lake
*Assistant Examiner*—Paul A. Bell
*Attorney, Agent, or Firm*—Salter & Michaelson

[57] ABSTRACT

A vacuum furnace in which work loads are periodically introduced and processed therein without breaking the vacuum within the furnace heating chamber and including spaced door assemblies between which chambers are defined for effectively isolating the work loads during the introduction and discharge therefrom, the apparatus further including transfer mechanisms that are sequentially operated in timed relation with the door assemblies and in accordance with the heat treating cycle of the furnace for moving work loads through the various stations in the furnace.

18 Claims, 19 Drawing Figures

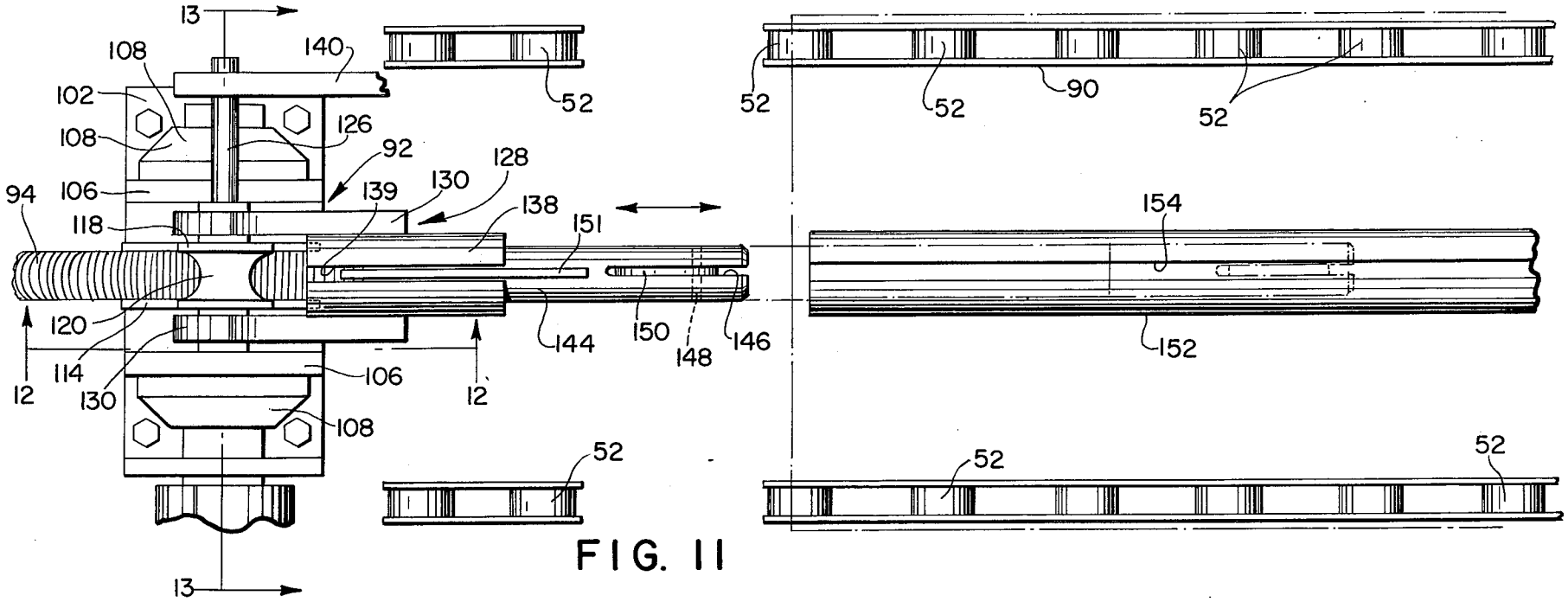
FIG. 11
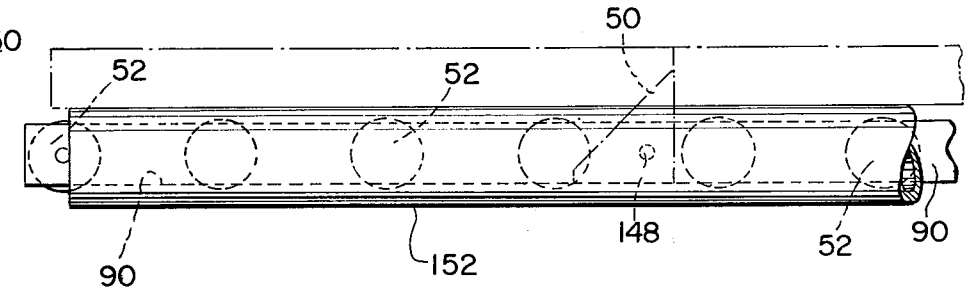
FIG. 12
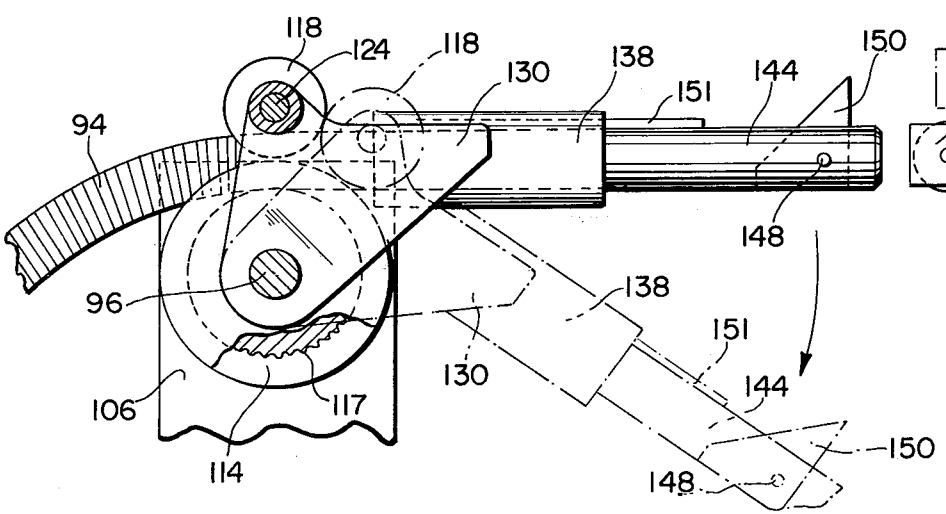

CONTINUOUS HEAT TREATING VACUUM FURNACE

BACKGROUND OF THE INVENTION

The present invention relates to vacuum furnaces and has particular application in the vacuum heating treating of work parts, wherein the work parts are introduced and processed in a subatmospheric environment and are thereafter removed from the furnace without closing down the operation of the furnace.

Prior to the instant invention, vacuum furnaces for heat treating and processing of metal articles have become generally accepted for commercial use; but, heretofore batch processing has been the generally accepted technique for use with vacuum furnaces; and, as a result, furnaces using the batch process have been somewhat limited in the use and application thereof. In this connection batch heat treating requires that the furnace be shut down after each heat treating cycle for removal of the processed work parts from the furance; and, although the results as obtained from such heat treating have been acceptable, it is understood that considerable time and labor is expended in shutting down the furnace, removing the parts therefrom, loading the furnace again, and then heat treating the new batch. Obviously, this technique is inefficient, since the furnace operation must be completely closed down during removal of the processed work parts and the introduction of the new parts therein.

Some efforts have been made heretofore to utilize continuously operated heat treating furnaces employing conveyor belts; but such furnaces have normally been usable in atmosphere environments, wherein an atmosphere has been introduced into the furnace heating chamber under pressure. In U.S. Pat. No. 3,782,705, a continuously operated vacuum furnace is disclosed; and, although the furnace as illustrated therein is capable of heat treating work parts without breaking the vacuum within the furnace, the door assemblies and conveyor mechanisms are somewhat complicated; and, therefore, the manufacture of such a furnace is relatively costly. Other attempts have been made to heat treat under vacuum in a continuously operated furnace, but problems have always been encountered in the loading of the work parts in the furnace and the unloading thereof without contaminating the furnace heating chamber.

SUMMARY OF THE INVENTION

The present invention relates to a vacuum furnace for continuously introducing and processing work parts through a heating chamber of the furnace for the heat treatment thereof without breaking the vacuum in the heating chamber, and wherein the heating chamber is operated at a predetermined subatmospheric pressure and temperature as the work parts are conveyed therethrough. In order to provide for continuous operation of the vacuum furnace embodied herein, a loading vestibule is provided with a unique vacuum sealed door assembly that is operable to move from a sealed vertical position to a substantially horizontal open position, whereupon a work load is directed into the loading vestibule in preparation for introduction into the heating chamber. Additional vacuum sealed door assemblies are provided in the system for protecting the heating chamber and enabling work loads to be removed from the cooling station of the furnace without discontinuing the operation of the heating chamber or breaking the vacuum therein.

The vacuum sealed door assemblies are so constructed and arranged as to avoid the usual elevated lifting unit that normally increases the overall height of the furnace and instead include an operating mechanism that provides for a combination lifting and pivotal action as each door member is moved to and from the sealed position.

The furnace as embodied herein further includes a unique load transfer mechanism that provides for the longitudinal movement of a flexible coil spring that is operable to transfer a work load through the various stations in the furnace. As the coil spring is moved by a motor in a longitudinal direction for transferring the work load, a reversing mechanism is actuated for effecting a retracting movement of the coil spring in preparation for the next transfer operation. An unload transfer mechanism that is located at the cooling station of the furnace also includes a longitudinally movable coil spring that is operable to withdraw a work load from the heating chamber into the cooling station following a heat treating operation, and following the cooling operation withdraws the work load from the cooling station to a discharge station.

Another feature of the invention provides for the cooling of the hydraulic fluid that is used in the operation of the various motors for operating the door assemblies and the like, the hydraulic fluid being circulated in a chamber that is adjacent to the cooling jacket of the furnace heating chamber wherein the heating chamber cooling jacket defines a heat exchanger for the hydraulic fluid for the effective cooling thereof.

Accordingly, it is an object of the present invention to provide a continuously operated vacuum furnace for heat treating metal articles in a subatmospheric environment therein, wherein a work load is periodically advanced through the various stations of the furnace for the heat treating thereof and without breaking the vacuum in the furnace heating chamber. Additional work loads are periodically introduced into the furnace and moved therethrough for the processing thereof in the subatmospheric environment, the work had being cooled and removed from the furnace without discontinuing the operation of the furnace heating chamber or breaking the vacuum therein.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention;

FIG. 11 is a top plan view of the work cart transfer mechanism and the pressure roll device for the drive spring and the tilting mechanism therefor;

FIG. 12 is a sectional view taken along line 12—12 in FIG. 11;

DESCRIPTION OF THE INVENTION

Figure 1:
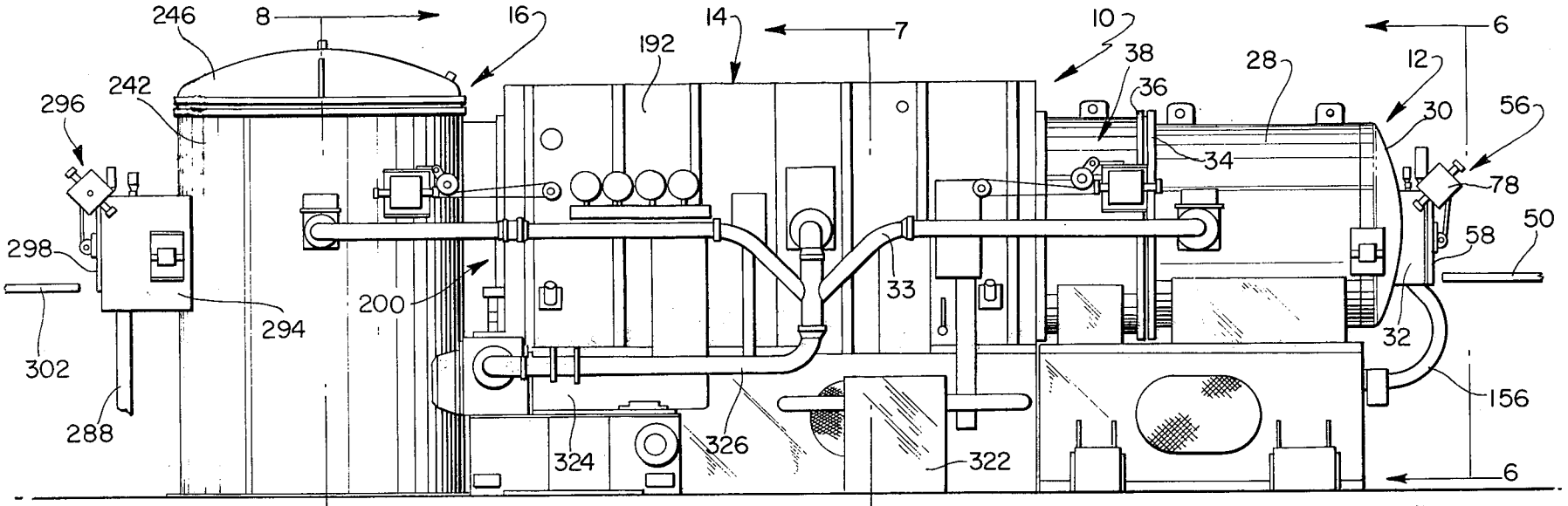
FIG. 1 is a side elevational view of the continuous heat treating vacuum furnace as embodied in the present invention.
Figure 2:
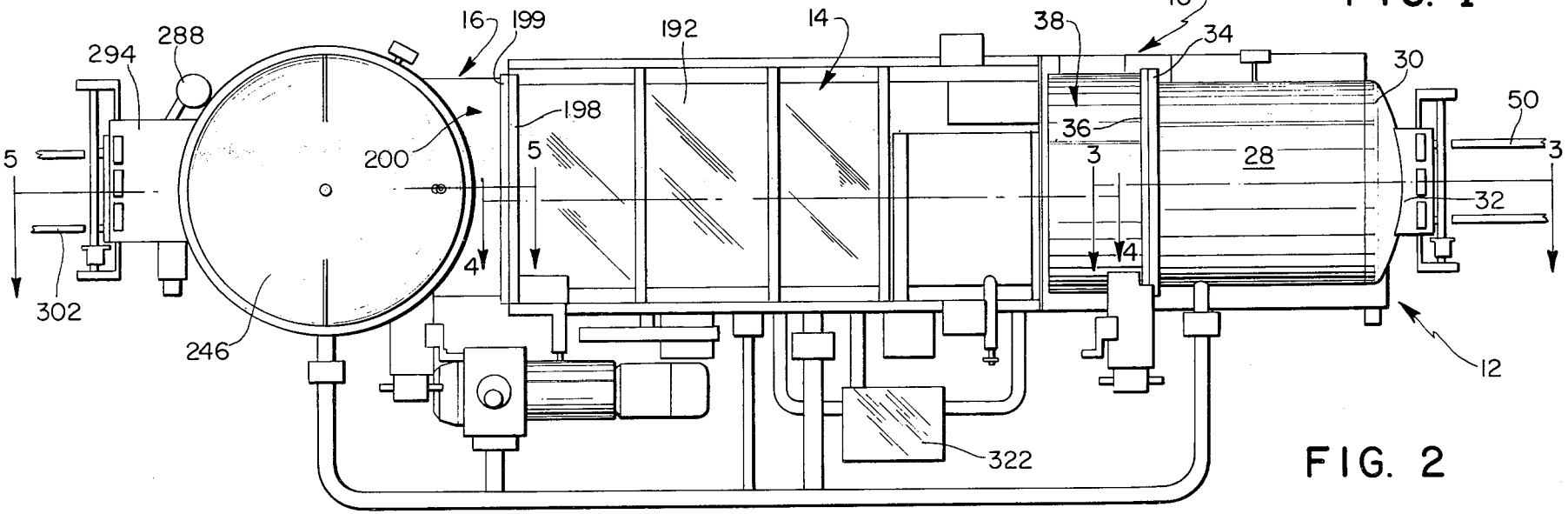
FIG. 2 is a top plan view thereof.

Referring now to the drawings and particularly to FIGS. 1 and 2, the continuously operated vacuum furnace embodied in the present invention is illustrated and is generally indicated at 10. As will be described, the vacuum furnace 10 is used for the heat treating of metal parts under subatmospheric conditions and continuously receives and processes the work parts without the requirement of discontinuing the operation of the furnace heating chamber or breaking the vacuum therein. The furnace 10 may be employed for a variety of heat treating operations that also include sintering and brazing and has particular application in the continuous carburizing of metal parts under vacuum.

Figure 3:
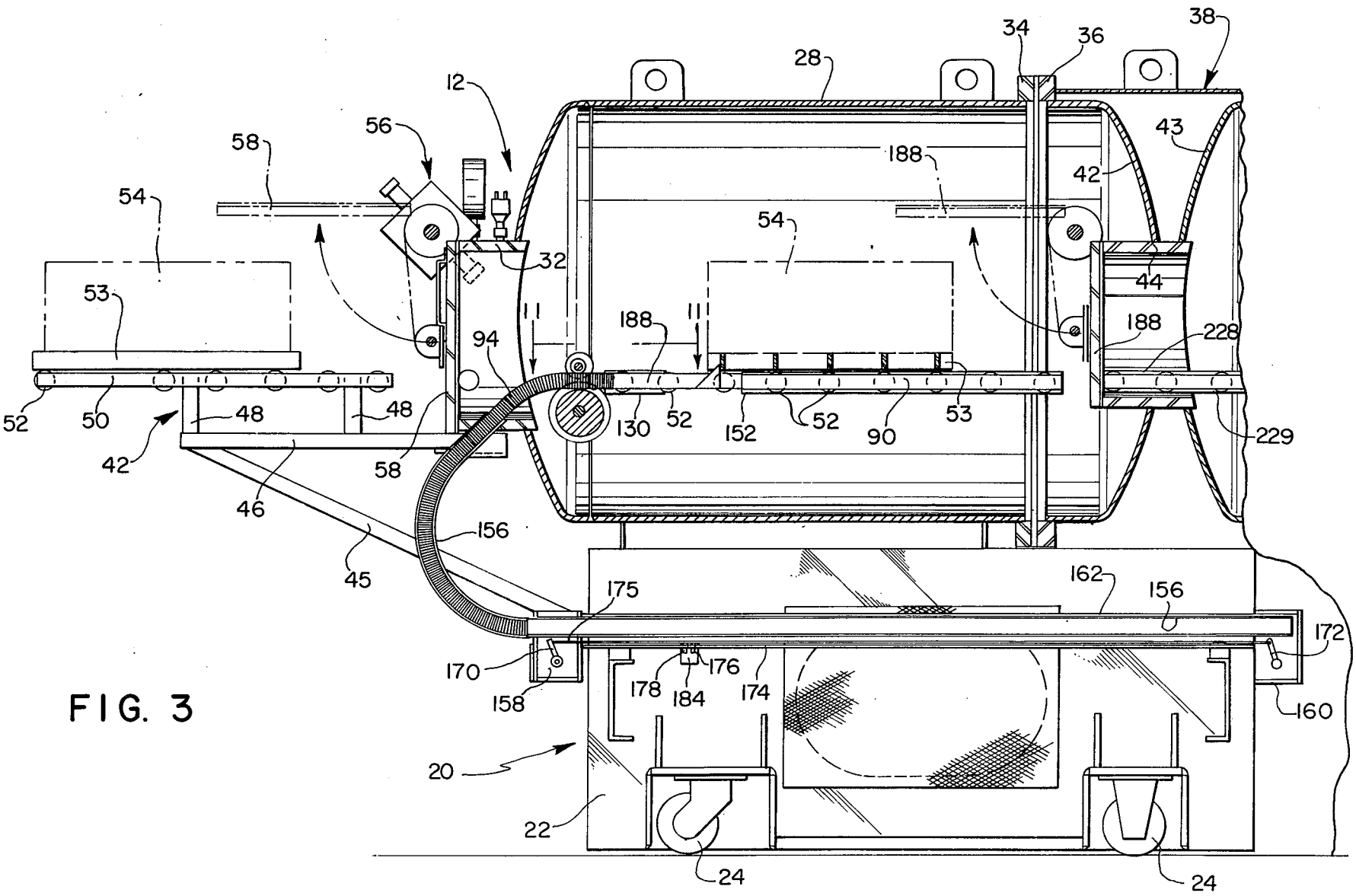
FIG. 3 is a sectional view taken along line 3—3 in FIG. 2, and showing the loading station including the loading vestibule and work cart transfer mechanism.
Figure 4:
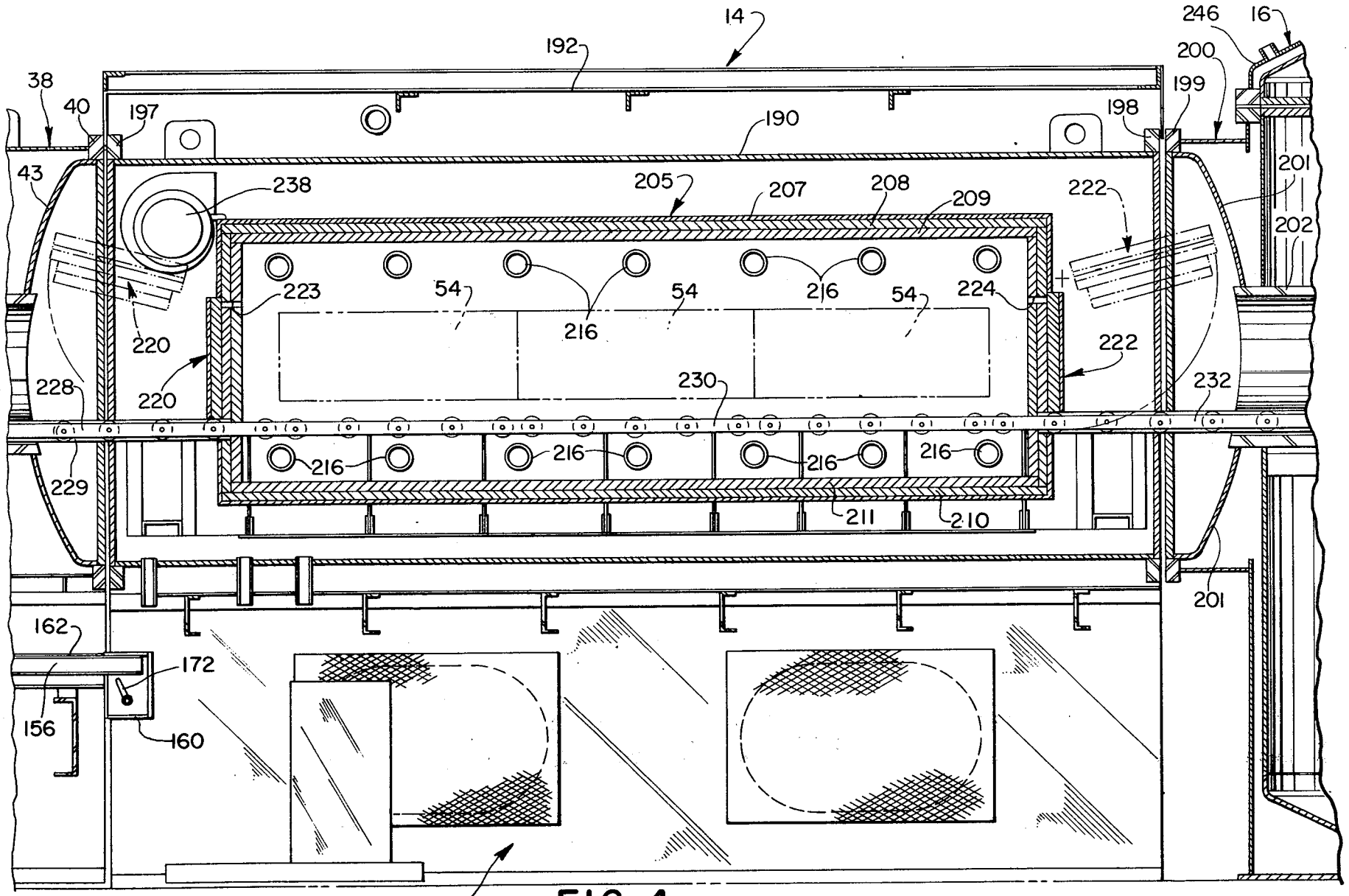
FIG. 4 is a sectional view taken along line 4—4 in FIG. 2, and showing the heating chamber.
Figure 5:
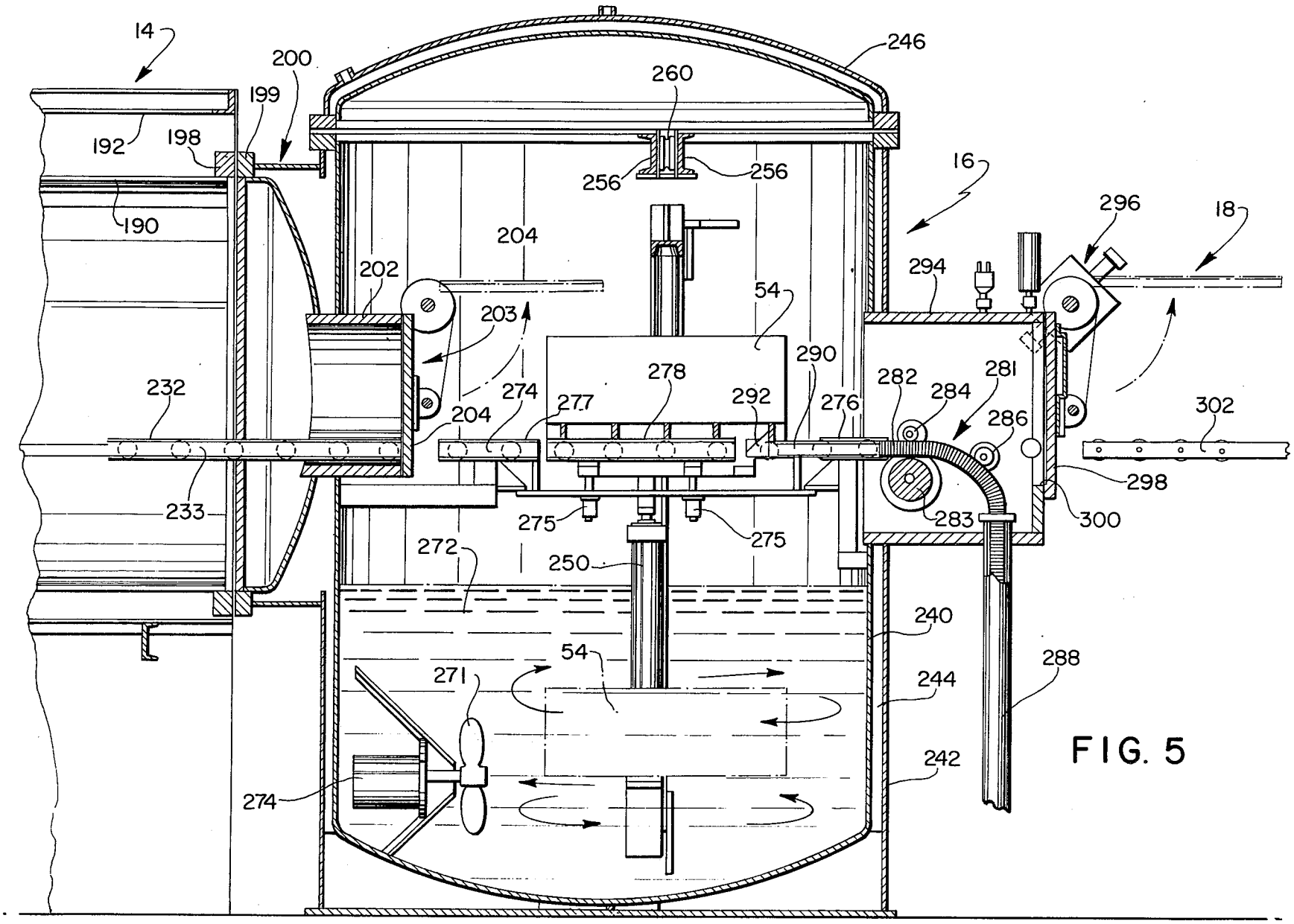
FIG. 5 is a sectional view taken along line 5—5 in FIG. 2, and showing the quench and discharge stations including the unload mechanism for retracting a work cart from the heating chamber and quench station.

Referring to FIGS. 3, 4 and 5, the vacuum furnace 10 as illustrated includes a loading station generally indicated at 12 (FIG. 3), a heating chamber generally indicated at 14 (FIG. 4) a quench station generally indicated at 16 (FIG. 5), and an unloading station generally indicated at 18 (FIG. 5). As will be described, the loading station 12, heating chamber 14, quench station 16 and the discharge station 18 are all interconnected end-to-end to define the complete furnace construction 10. However, the various units are so constructed that they are easily assembled and are somewhat modular in arrangement for modifying the location of the units as required and as will be described.

Figure 6:
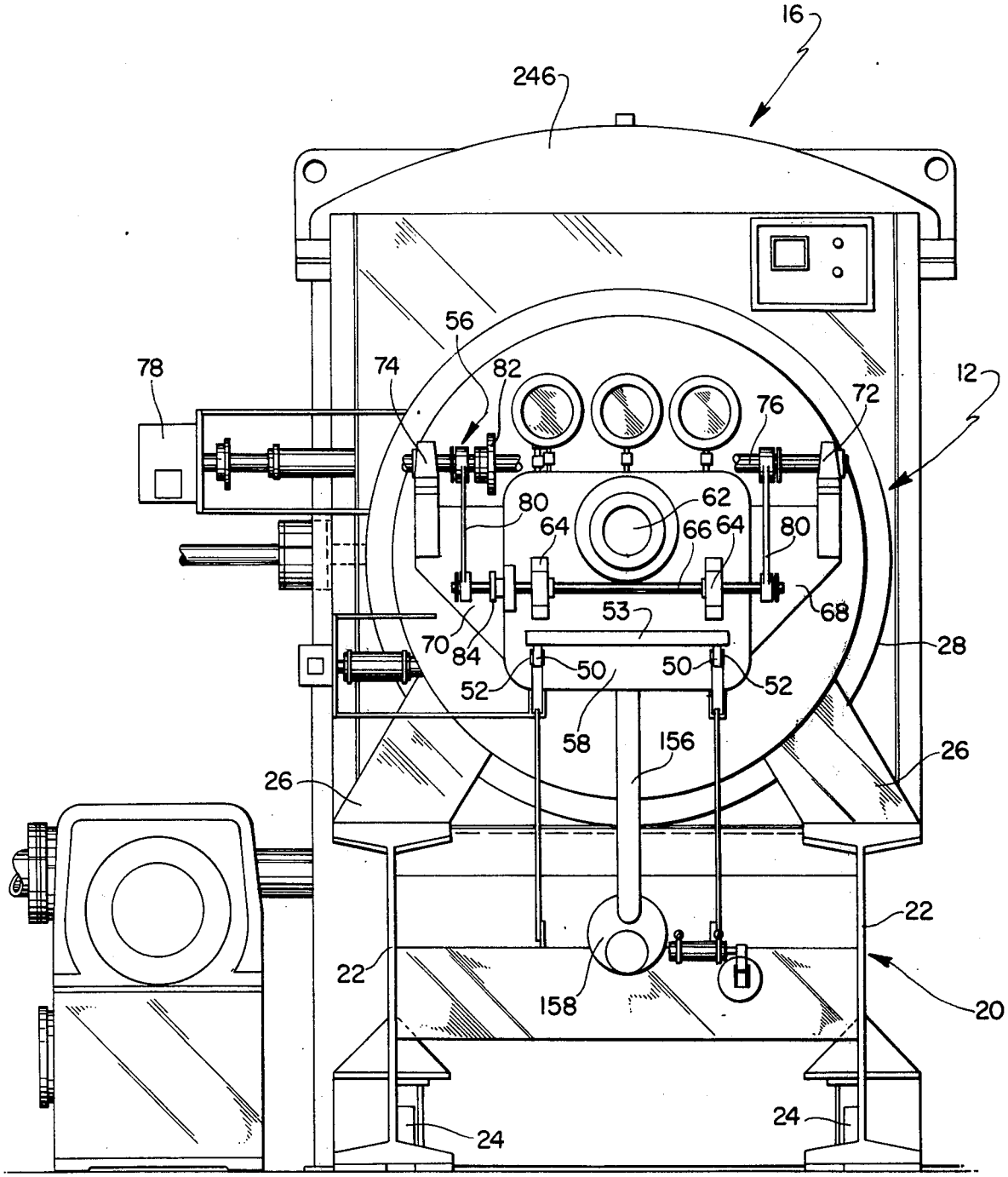
FIG. 6 is a front elevational view of the vacuum furnace embodied herein and taken along line 6—6 in FIG. 1.

Referring now to FIG. 3, the loading station 12 is illustrated in detail and is mounted on a base generally indicated at 20 that includes spaced beams 22 having casters 24 located at the lower end thereon for facilitating the assembly of the loading station 12 with the other furnace units. As further shown in FIG. 6, supports 26 are mounted on the spaced beams 22 for supporting a shell 28 in which the loading vestibule of the loading station 12 is defined. The shell 28 includes a front wall 30 having a generally convex configuration in which a central opening is formed for receiving a tubular door frame 32 therein. Mounted on the rearmost end of the shell is a flange 34. Secured to the flange 34 of the shell 28 by a rear flange 36 is a separable intermediate connecting section generally indicated at 38. The connecting section 38 further includes a forward flange 40 that is sealed to a flange of the heating chamber 14 as will be described (FIG. 4). Formed as part of the connecting section 38 is a convex wall 42 that cooperates with the front wall 30 to complete the shell construction. A wall 43 is also formed as part of the connecting section 38 and defines the forward wall of the heating chamber 14. Secured to the walls 42 and 43 is an interior door frame 44 that provides for communication between the shell loading vestibule with the heating chamber 14. Suitable bolts secure the flanges 34 and 36 together, and the shell 28 and connecting section 38 are formed in modular relation so as to be interchanged in different positions depending on the end use of the furnace.

Located exteriorly of the loading vestibule as defined by the shell 28 and formed as a part of the loading station 12 is a loading platform generally indicated at 42 that includes spaced inclined supports 45 that are joined to the base 20 and to which horizontal supports 46 are secured at the outermost end thereof. The innermost ends of the supports 46 are locked on sleeves 47 that are secured to the underside of the door frame 32. Vertical struts 48 are mounted on the horizontal supports 46 and support spaced loading tracks 50 that are formed in the spaced-apart sections between which a plurality of rollers 52 are mounted for receiving a work cart 53 on which a work load 54 diagrammatically illustrated in FIG. 3 is mounted.

One of the unique features of the present invention is the door assembly that seals the various stations and that is operable to provide communication therebetween. As will be described, each of the door assemblies is movable in a manner that not only provides complete access to the station with which it communicates, but also avoids the use of a mechanism that extends upwardly above the furnace construction as heretofore known, which construction materially reduced the overall vertical dimension of the apparatus with which it was employed.

Figure 10:
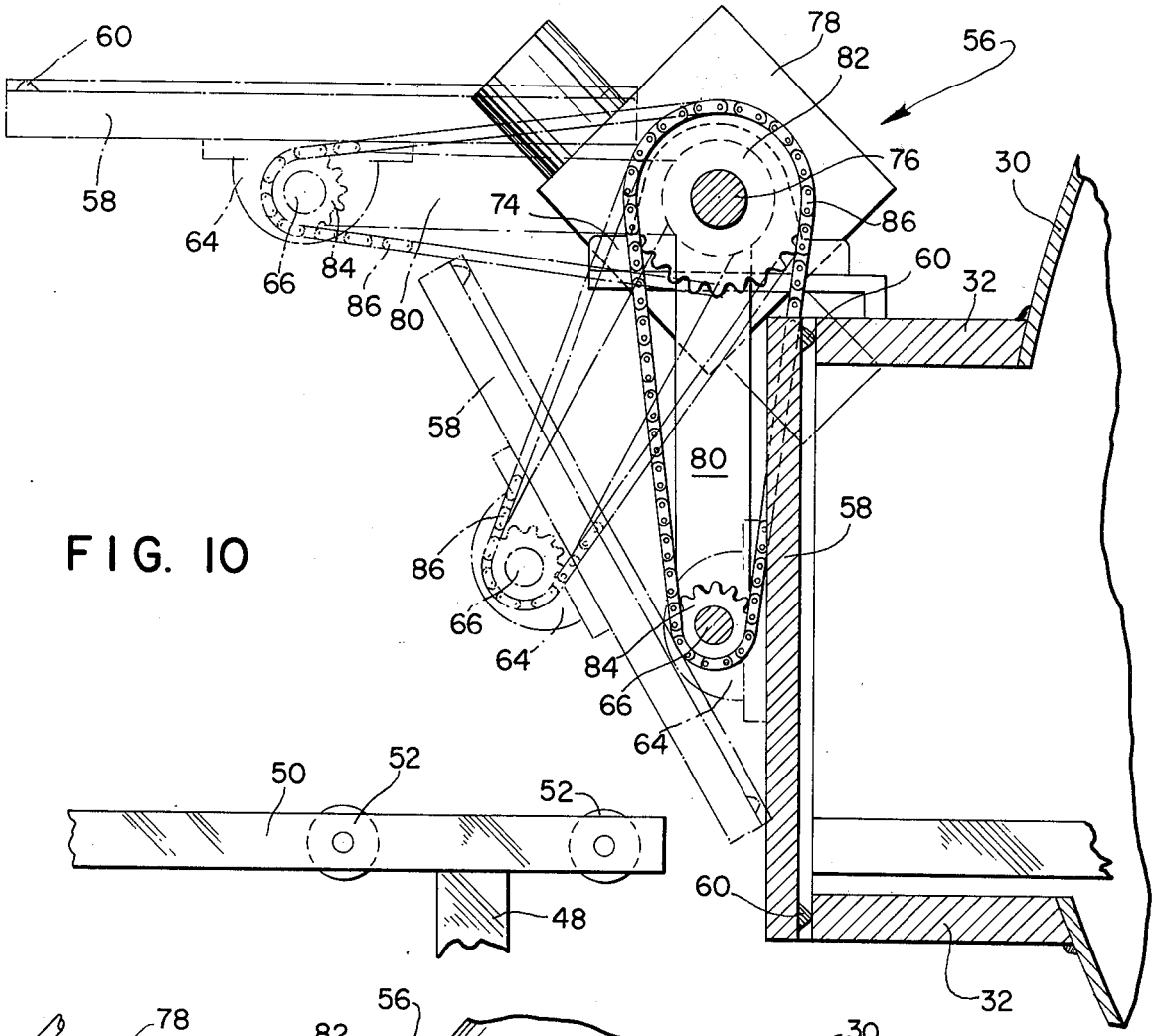
FIG. 10 is a sectional view with parts shown in elevation of the loading station door assembly and illustrating the sequential movement of the door member from the closed to the open positions.
Figure 9:
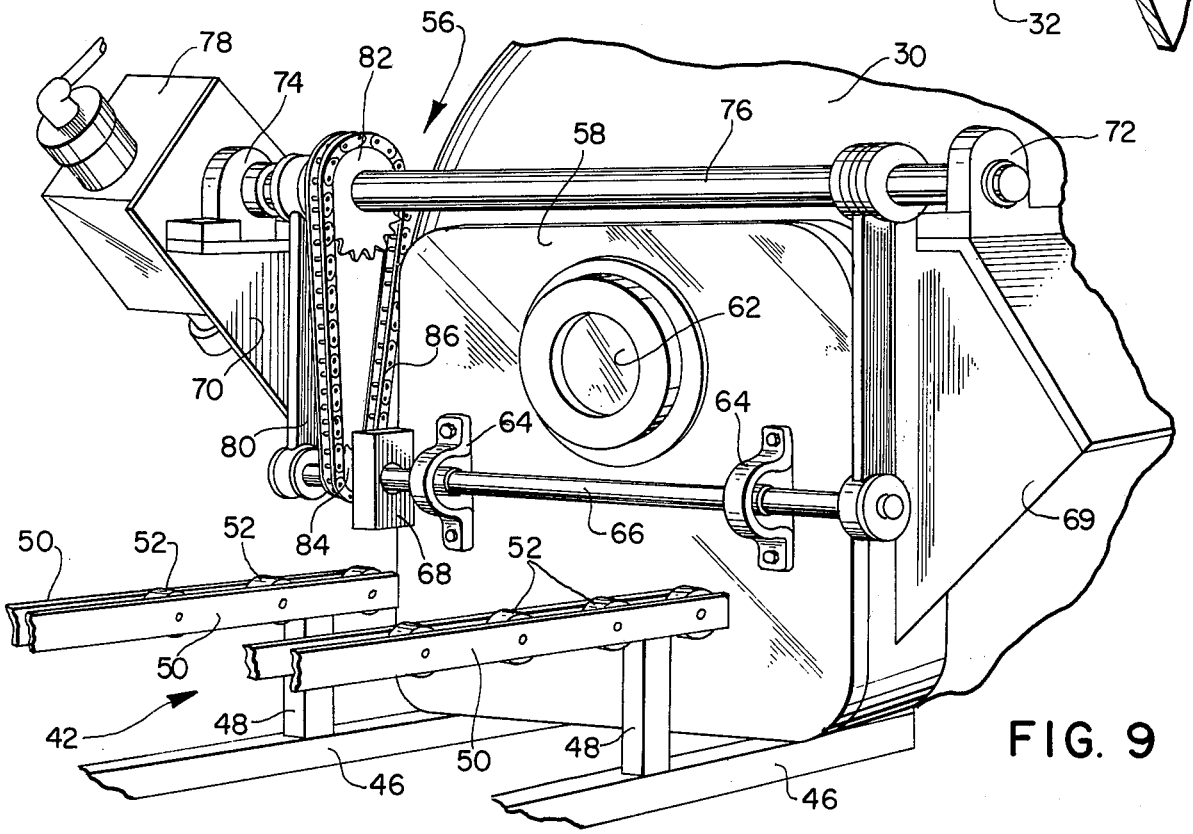
FIG. 9 is a perspective view of the door assembly and operating mechanism therefor as located at the loading station.

Referring now to FIGS. 9 and 10, one of the door constructions is illustrated and is generally indicated at 56. The door assembly 56 as shown is located at the loading station and seals communication between the loading platform 42 and the interior of the loading vestibule in the shell 28; although, it will be understood that the constructional arrangement and the operation of the other vacuum sealing door assemblies is the same as that illustrated in FIGS. 9 and 10. The door assembly 56 includes a door member 58 that is generally square in configuration and that is designed to seal the opening as formed in the frame 32 mounted in the opening in the front wall 30 of the shell 28. For this purpose a marginal groove is formed on the inner face of the door member 58 for receiving an O-ring seal 60 as illustrated in FIG. 10. The seal 60 normally engages the adjacent edges of the door frame 32 in sealing engagement therewith when the door assembly 56 is located in the closed position thereof. Formed in the door member 58 is an opening for receiving a frame having a sight port 62 mounted therein that enables the interior or vestibule of the shell 28 to be observed after the door member 58 has been moved to the closed position thereof. Fixed to the outer surface of the door member 58 are spaced trunions 64 that receive a rod 66 in rotatable relation therewith. A bearing block 68 is also secured to the outer surface of the door member 58 and acts to support a sprocket gear as will hereinafter be described.

Secured to the door frame 32 at the sides thereof are spaced brackets 69 and 70 on which bearings 72 and 74 are mounted. Journalled for rotation in the bearings 72 and 74 is a drive shaft 76, the outermost end of which is engageable by a hydraulically operated motor 78. Fixed to the drive shaft 76 is spaced relation beyond the sides of the door member 58 are links 80, the other ends of which are fixed to the outer ends of the rod 66. Thus, upon rotation of the drive shaft 76, the links 80 are movable therewith to pivotally move the door member 58 in a corresponding motion.

The operation of the door assembly 56 is also unique in that the door member 58 is reversely rotated on the axis of the rod 66 as it is pivotally moved to and from the closed and open positions. By providing for the movement of the door member 58 in this manner, less space is required for movement thereof, thereby enabling the loading platform 42 to be located closely adjacent to the loading shell 28. Referring again to FIGS. 9 and 10, a sprocket gear 82 is shown that is fixed to a hub that is, in turn, mounted on the front wall 30 of the loading shell 28. A smaller sprocket gear 84 is mounted on a hub that is secured to the block 68, the block 68 as described hereinabove being secured to the door member 58. Interconnected to the sprocket gears 82 and 84 is a nonrotating sprocket chain 86; and, as will be described, the sprocket chain 86 is provided for effecting a rotating movement of the rod 66 and door member 58 fixed thereto relative to the shaft 76. As shown, the ratio of the gear 82 to the gear 84 is 2:1, which provides that radial movement of the door member 58 joined to the sprocket chain 86 through the block 68 and gear 84 is twice that of the drive shaft 76. Hence, as the drive shaft 76 pivots the links 80 and door member 58 joined thereto, the interconnection of the gears 82 and 84 by the sprocket chain 86 produces a 2:1 counter rotating movement of the door member 58. As more clearly illustrated in FIG. 10, when the links 80 secured to the shaft 76 are moved to the upper horizontal position, the door member 58 is simultaneously, reversely or counterrotated relative to the shaft 76 and links 80 to a substantially, horizontal upper position. It is seen from the movement of the door member as illustrated in FIG. 10 in phantom that the counterrotating movement of the door member 58 is accomplished in a relatively small space and that the reverse rotation of the door member 58 not only accomplishes the purpose of effectively locating the door member in the open position as indicated, but that the seal 60 is disposed in an upper protected position. As will be described hereinafter, the door assemblies that are located interiorly of the furnace and adjacent to the heating chamber are operated in substantially the same manner, and by locating the seal 60 in protected relation behind the door member when the door member is open the seals in the interior door assemblies are protected rom the heat emanating from the heating chamber.

Mounted in the loading shell 28 and in alignment with the track sections 50 of the loading platform 42 are longitudinally spaced track sections 88 and 90, both of which are comprised of pairs of spaced-apart track members between which rollers similar to rollers 52 are mounted for rotation. A cart 53 carrying a work load 54 is receivable on the rollers 52 of the track sections 88 and 90 for transfer through the shell 28 and into the heating chamber 14, as will be described.

Figure 13:
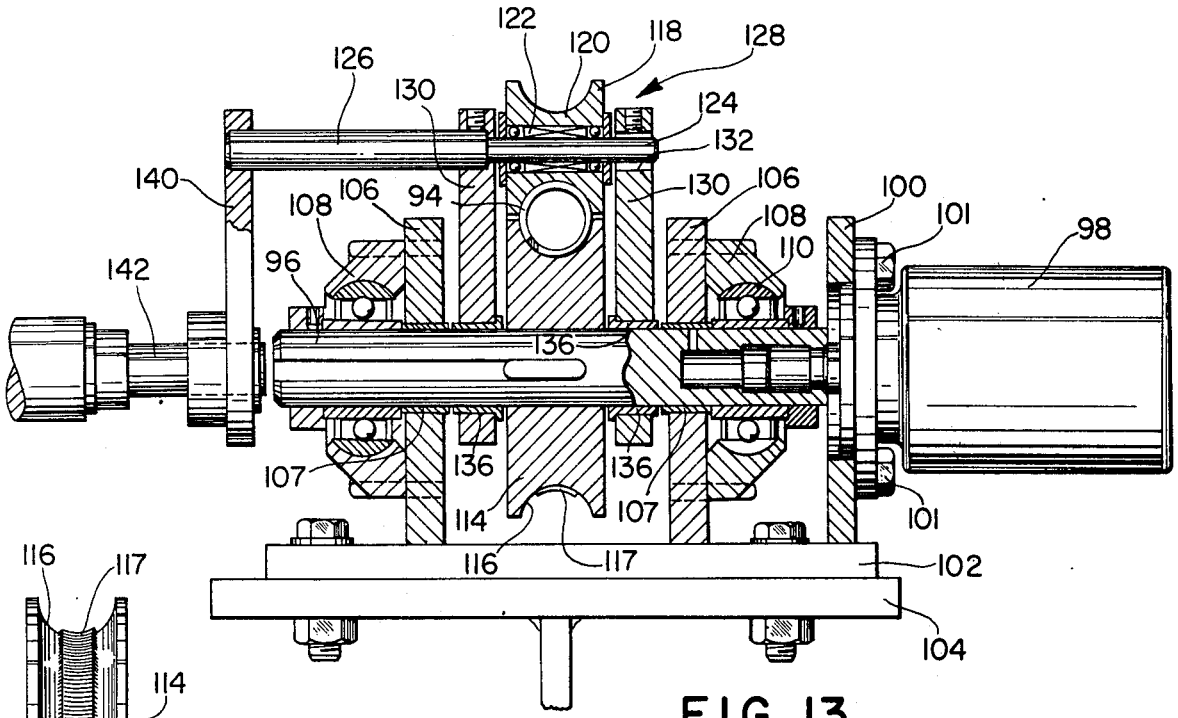
FIG. 13 is a sectional view taken along line 13—13 in FIG. 11.
Figure 13A:
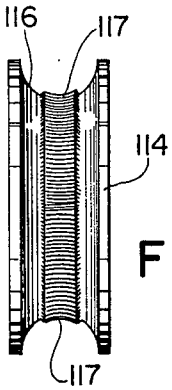
FIG. 13a is an end view of the drive pulley as used in the transfer mechanism.

Another unique feature of the invention embodied herein is the load and unload transfer mechanisms for moving the work cart 53 through the loading shell 28 and into the heating chamber, and thereafter to the quench and unloading stations. Referring now to FIGS. 3, 11 and 12, the load transfer mechanism is illustrated and is generally indicated at 92; and as later described, the unload transfer mechanism is substantially similar thereto in structure and in operation. The load transfer mechanism 92 includes an elongated flexible drive spring 94 which is a conventional coil spring, and, as illustrated in FIG. 3, projects from the interior of the shell 28 to the outside thereof, and then extends beneath the shell within a tubular housing, as will be described. In order to effect a longitudinal or linear movement of the flexible drive spring 94, the drive mechanism 92 includes a drive shaft 96, which as illustrated in FIG. 13 is coupled to a motor 98 mounted on a bracket support 100 by bolts 101. The bracket support 100 is mounted on a base 102 that is, in turn, secured to a plate 104 fixed to the interior of the shell 28. Also supported by the base 102 are spaced brackets 106 in which apropriate bushings 107 are mounted for receiving the shaft 96 in bearing relation therein. Spaced pillow blocks 108 are mounted on the brackets 106 and carry bearings 110 therein in which the shaft 96 is rotatably mounted. Fixed to the shaft 96 intermediate the brackets 106 is a drive pulley 114 that is formed with a concave groove 116 therein, in which spaced teeth 117 are formed. As shown in FIG. 13*a*, the teeth 117 are formed only in the bottommost portion of the groove 116 and are pitched to accommodate the spirally extending coils of the spring 94. By locating the teeth 117 in this manner the coils of the spring 94 remain in driving contact with the teeth 117 and do not tend to ride out of the groove 116 as the spring is moved longitudinally during a loading or retracting operation.

In order to effectively retain the teeth 117 of the drive pulley 114 in engaging relation with the coils of the spring 94 for producing the linear movement of the spring, a retaining roller 118 is provided; and as illustrated in FIGS. 11 and 13, the retaining roller 118 is also formed with a groove 120 that conforms to the configuration of the coils of the spring 94 and fits thereover to urge the spring into the groove 116 of the drive pulley 114. Fixed in the roller 118 are needle bearings 122 which receive the reduced end 124 of the shaft 126 therein and thereby rotatably mount the roller 118 on the shaft 126. As will be described, the roller 118 must be pivoted relative to the drive spring 94 to a position that will permit transfer of the work cart 53 inwardly of the forewardmost end of the drive spring 94 so that the cart will be located in a position to permit the transfer movement thereof into the heating chamber 16. For this purpose, the roller 118 is pivoted relative to the drive spring 94 and the drive shaft 96 on which the drive pulley 114 is mounted by securing a swivel bracket generally indicated at 128 on the shaft 126. As shown in FIG. 11, the swivel bracket 128 includes spaced plates 130 having upper openings 132 formed therein for receiving the reduced shaft 124 and shaft 126. Larger lower openings 134 are also formed in the plates 130 for receiving appropriate bushings 136 in which the shaft 96 is mounted for rotation. A guide tube 138 (FIG. 11) having a slot 139 formed therein is secured between the plates 130 and extends fowardly thereof and receives the spring 94 therein. In order to produce the pivotal or swivel movement of the swivel bracket 128 that carries the retaining roller 118, a lever 140 is provided and is secured to an end of the shaft 126 as shown in FIG. 13. The lever 140 is secured to a motor shaft 142 that is operatively interconnected to a hydraulically operated motor that is sequentially actuated to pivotally move the lever 140 and thereby produces the swivel movement of the swivel bracket 128 and the pressure roller 118 carried thereon. As further illustrated in FIG. 12, a pusher bar 144 is secured to the interior end of the spring 94, the pusher bar 144 extending beyond the guide tube 138 and terminating in a slot 146 (FIG. 11). Secured in the slot 146 by a pin 148 is a pusher element 150 that cooperates with the pusher rod 144 to produce a feeding movement of a work cart with which it has been engaged during a transfer operation. Extending through the slot 139 of the tubular guide 138 and outwardly thereof for engagement with the pusher arm 144 is a keystock 151 that prevents the pusher arm from turning, and thus orients the pusher element 150 for the entry thereof into a tubular guide in the shell 28 as will be described. It is seen that the drive spring 94 is longitudinally driven by the rotation of the drive pulley 114, the pusher bar 144 and pusher element 150 secured thereto being movable with the spring 94 in its linear travel. As further shown in FIGS. 11 and 12, an elongated tubular guide member 152 is mounted within the shell 28 between the track sections 90 and is formed with a central slot 154 therein for receiving the pusher element 150. As the drive spring 94 directs the pusher bar 144 interiorly of the shell 28 and the pusher element 150 is received in the slot 154, the pusher bar 144 and spring 94 enter the tubular guide member 152. As will be described, the pusher element 150 is engageable with a rear cross bar of a work cart 53; and, as the drive spring 94 continues its longitudinal movement interiorly of the shell 28, the work cart is moved through the shell 28 and door frame 44 and into the heating chamber 16 during a work load transfer operation.

Figure 16:
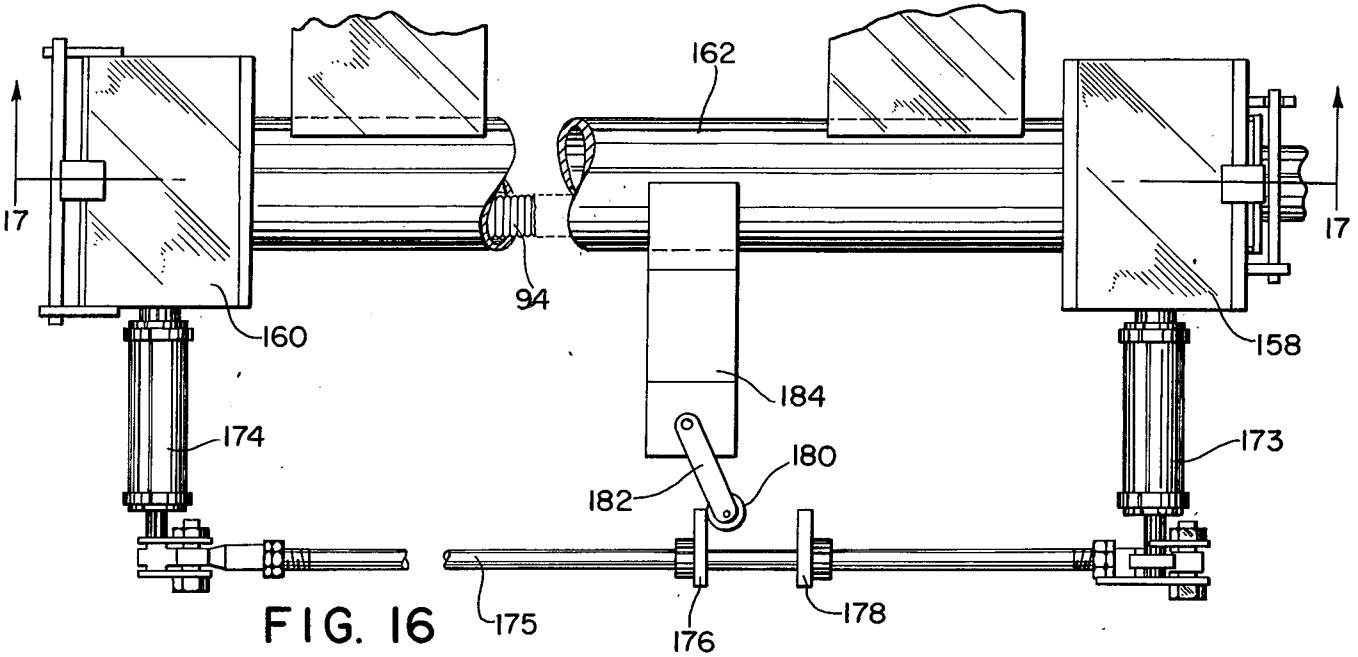
FIG. 16 is a top plan view with portions broken away of the reversing mechanism that is utilized to return the work load transfer mechanism to its original position following a transfer operation.
Figure 17:
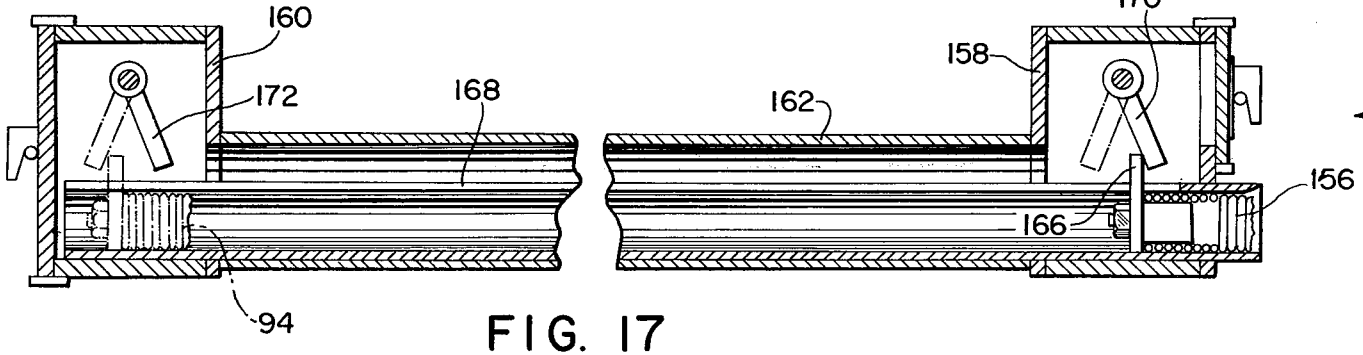
FIG. 17 is a sectional view taken along line 17—17 in FIG. 16.

As illustrated in FIG. 3, the rear portion of the drive spring 94 projects outwardly of the loading shell 28 and extends into a sealed tube 156 that projects beneath the loading shell in curved relation and then extends thereunder in parallel relation. Thus, the spring 94 is movable within the sealed tube 156 in a forwardly direction within the loading shell 28 during a feeding movement and rearwardly of the shell 28 as it is retracted in the tube 156. In order to effect the reverse movement of the drive spring 94 to retract the pusher bar 144, it is necessary to reverse the operation of the motor 98 in accordance with a predetermined movement of the spring, and for this purpose a spring reversing assembly is provided. Referring now to FIGS. 16 and 17, the spring reversing assembly is illustrated and as shown includes a bustle 158 that is mounted on the base 20 and receives the tube 156 therein. Spaced from the bustle 158 is a second bustle 160 that is also mounted on the base 20, and joining the bustles in sealed relation is a cylinder 162. Projecting through the bustle 158, cylinder 162 and into the bustle 160 in sealed relation is the tube 156 through which the spring 94 extends.

As shown in FIG. 17, the spring 94 as it is received within the inner tube 156 has a tab 166 joined to the end thereof, the tab 166 extending upwardly through a slot 168 as formed in the portion of the tube 156 that is located in the cylinder 162. The tab is located between arms 170 and 172 that are mounted for pivotal movement in the bustles 158 and 160, respectively, the tab 166 being movable by the spring 94 the distance that is defined between the arms 170 and 172 as the spring 94 is moved in a feeding operation by the motor 98. As shown in FIG. 16, the arms 172 extend outwardly of the bustles 158 and 160, respectively, through vacuum seals 173 and 174 and are interconnected by linkages to an elongated connecting rod 175. Mounted on the elongated connecting rod 174 intermediate the ends thereof are limit stops 176 and 178, and extending between the limit stops 176 and 178 is a roller 180 that is secured to a switch arm 182 of a limit switch 184. The limit switch 184 is electrically interconnected to the motor 98 and is operative to control the direction of rotation of the motor 98 for producing either forwardly or rearwardly feeding of the drive spring 94. It is seen that as the drive spring 94 is moved to the endmost position in a transfer or feeding operation, the tab 166 will strike the arm 170 to produce a corresponding longitudinal movement of the rod 174 thereby reversing the operation of the switch 184. The operation of the switch 184 then reverses the operation of the motor 98 to immediately retract the drive spring 94 to the original position thereof and to place the pusher arm 144 in position for the next transfer operation. As the tab 166 is returned to the original position thereof it engages the arm 172, thereby moving the rod 175 to again reverse the operation of the motor 98. A time delay may be utilized to delay the operation of the motor for the next feeding movement of the drive spring.

As already described, the retaining roller 118 is provided for positively urging the drive spring 94 into engagement with the drive pulley 114. When a work cart 53 is introduced into the loading shell 28, the roller 118 would normally restrict the inward movement of the work cart. In order to allow free movement of the work cart into the loading shell 28, the pressure roller 118 is pivotally moved forwardly of its normal position by the swivel bracket 128 from the full line position shown in FIG. 12 to the dotted line position thereof, thereby depressing the roller 118, the guide tube 138, pusher bar 144 and pusher element 150. After the work cart 54 has entered into the loading shell 28 forwardly of the pusher element 150, the swivel bracket 128 is thereafter returned to the normal position thereof by pivotal movement of the lever 140, the pusher element 150 moving into engagement with the rearmost cross bar of the work cart 54, and the retaining roller 118 once again engages the drive spring 94 to urge it into driving relation with the drive pulley 114.

When a work cart 53 is introduced into the loading shell 28, an interior door assembly generally indicated at 186 that is disposed in a vacuum sealed position relative to the door frame 44 seals communication between the loading shell 28 and the heating chamber 16. The door assembly 186 which includes a door member 188 is moved to and from a vacuum sealed position in the manner as previously described with respect to the door member 58 of the door assembly 56. In this connection, the door member 188 is usually disposed in a sealed position when the door member 58 is open to receive a work cart 53 for introduction of a work load into the loading shell 28. As will be described, the heating chamber 14 is at all times maintained under a predetermined vacuum and temperature, so that the operation of the furnace is substantially continuous, in that a vacuum and a predetermined temperature is maintained in the heating chamber 14 during all phases of the operation of the furnace.

Prior to introduction of the work load into the loading shell 28, the door assembly 186 is moved to the sealed position, whereafter an atmosphere is introduced into the loading shell 28 until atmospheric pressure is obtained. In accordance with the cycle of operation, the door assembly 56 is operated to move the door member 58 to the open position thereof. After the work load has been moved into the loading shell 28, and with the door member 188 still in the sealed position, the door member 58 is sealed and the loading shell 28 is evacuated until the vacuum therein is substantially the same as that of the heating chamber 14. Thereafter, the door member 188 is moved to the open position and the work load 54 is transferred through the door frame 44 into the heating chamber by the longitudinal feeding movement of the drive spring 94.

Figure 7:
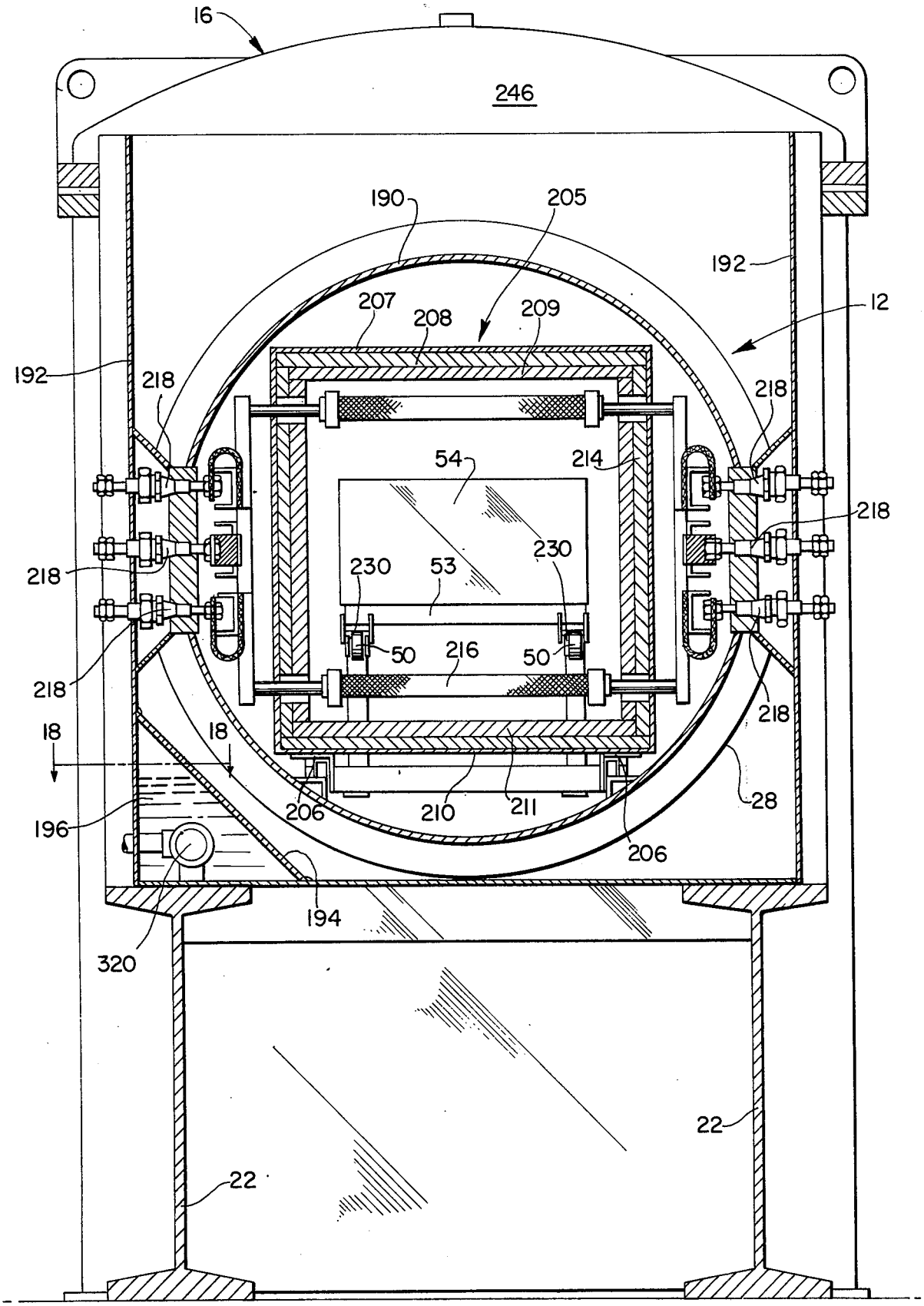
FIG. 7 is a sectional view through the furnace heating chamber taken along line 7—7 in FIG. 1.

Referring now to FIGS. 4 and 7, the heating chamber 14 is illustrated and as shown includes an inner shell 190 having substantially a circular cross-sectional configuration and that is mounted within an outer shell 192, which as shown in FIG. 7 has substantially a square cross-sectional configuration. Suitable supports are provided for locating the inner shell 190 within the outer shell 192, the outer shell being supported by the spaced beams 24 that extend longitudinally of the furnace. The inner shell 190 is water cooled, the space that is defined by the inner and outer shells forming a water jacket through which water is circulated for effectively cooling the inner shell 190 during the operation of the furnace. As will be further described, an inner inclined wall 194 (FIG. 7) extends the length of the outer shell 192 and defines an interior chamber 196 in which hydraulic fluid is circulated, the chamber 196 acting as a cooling chamber for the hydraulic fluid utilized in the various hydraulic motors used throughout the system.

The forward end of the inner shell 190 has an annular flange 197 secured thereto that is fixed in mating relation to the flange 40 for interconnecting the connecting section 38 and the heating chamber in sealed relation. The other end of the inner shell 190 also has an annular flange 198 secured thereto that is fixed to a flange 199 of an intermediate connecting section generally indicated at 200 and that includes a domed wall 201 in which an opening is formed for receiving a door frame 202. Mounted on the door frame 202 is a vacuum sealed door assembly 203 that includes a door member 204, the door assembly being constructed and operated similar to the door assembly 56 and controlling access from the heating chamber 14 to the quench station 16.

Located interiorly of the shell 190 of the heating chamber 14 is a heating area that is defined by a cage generally indicated at 205. Located exteriorly of the cage 205 are supports 206 therefor that are mounted on the interior of the inner shell 190. Defining the exterior of the cage 205 is a mild steel wire mesh 207 to which exterior layers 208, 210 and 214 of alumina-silica fibers and interior layers 209, 211 and 212 of graphite fibers are secured therebetween, the exterior and interior layers defining the heating area. Projecting through the side layers 212 and 214 and the wire mesh 207 of the cage 205 are terminal portions of a plurality of heating elements 216 which are tubular in construction and which are also formed of a woven graphite material of the type described in U.S. Pat. No. 3,525,795. Joined to the terminal portions of the heating elements 216 are bars 217 that are electrically connected to terminals 218, the terminals 218 extending outwardly of the heating chamber 14 and being connected to appropriate electrical connectors that are interconnected to a source of power located exteriorly of the furnace. As shown more clearly in FIG. 4, thermal doors generally indicated at 220 and 222 are mounted exteriorly of the cage 205 adjacent to the ends thereof. The thermal door 220 controls access through a forward opening 223 of the cage 205, while the thermal door 222 controls access through a rear opening 224. Both of the doors 220 and 222 are operatively interconnected to the adjacent vacuum sealed door assembly so that operation of the door assembly 186 produces a corresponding movement of the thermal door 220. Similarly, the thermal door 222 is moved to an open and closed position in accordance with the operation of the vacuum sealed door assembly 203 that controls access between the heating chamber 14 and quench station 16. As further illustrated in FIGS. 3 and 4, a track section 228 extends from the door frame 40 to the thermal door assembly 220. Located intermediate the track elements of the track section 228 is a tubular guide member 229 that is aligned with the guide member 152 and receives the pusher bar 144 and drive spring 194 therein during a work load transfer operation. An independently mounted track section 230 is located within the heating area interiorly of the cage 205, while a track section 232 is mounted downstream and exteriorly of the cage 205 and extends into the tubular door frame 207 disposed at the discharge side of the heating chamber 14. A tubular guide member 233 is located intermediate the track elements of the track section 232 and receives a puller bar and retract spring therein as will be described. The longitudinal dimension of the cage 198 is constructed such that three of the work carts 53 located in end-to-end relation may be accommodated therein. Thus, as each cart 53 is introduced into the loading shell 28 and thereafter moved into the heating chamber 14, the last cart loaded engages the cart in front and subsequent operation of the transfer mechanism causes the drive spring 94 to advance the carts and loads therein forwardly to the next position. As will be described, a retract or unload mechanism is utilized to remove the forwardmost load from the heating chamber for location at the quench station 16, the load and unload mechanisms cooperating to continuously advance the work loads through the various stations. As will also be described, a load will be located within the heating chamber 14 for at least three feeding operations, and the heat treating operation of the work load as contained on a cart in the heating chamber is controlled accordingly. If desired a fan 238 may be mounted in the heating chamber 14 for communication with ducting for circulating a carburizing gas within the heating chamber during the carburizing operation.

Following the heat treating operation, a work load is moved from the heating chamber 14 into the quench station 16, access into the quench station being controlled by the vacuum sealed door assembly 203. The operation of the door assembly 203 is substantially identical to that described above in connection with the door assembly 56, the movement of the door member 204 of the door assembly 203 effecting the same movement as the door member 58 described hereinabove. The door frame 202 which extends into the quench station 16 provides for communication of the heating chamber 14 and the quench station 16, and as illustrated in FIG. 5, the door assembly 203 is operable to seal communication between the heating chamber 14 and the quench station 16 as required.

Figure 8:
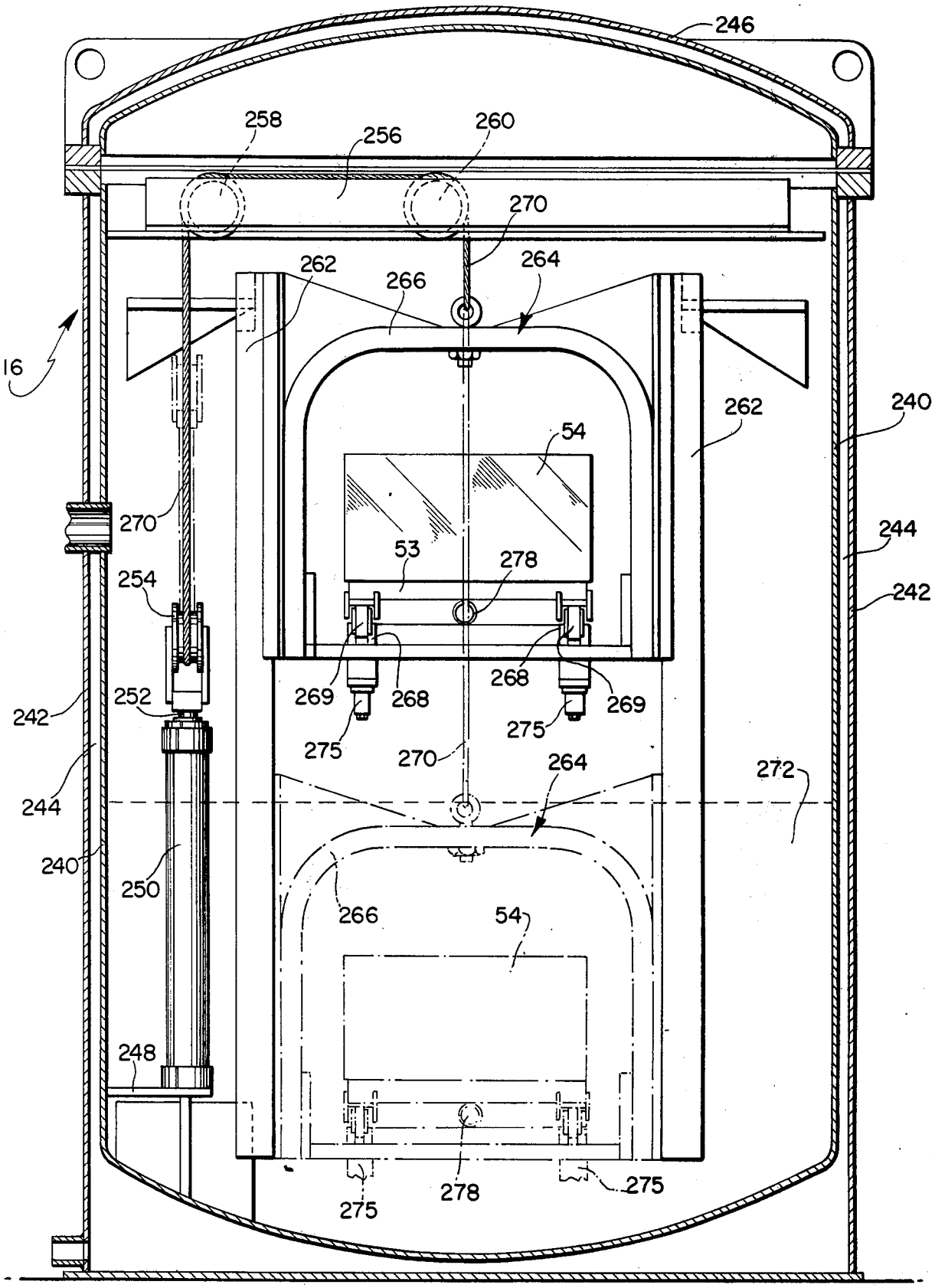
FIG. 8 is a sectional view of the quench tank taken along line 8—8 in FIG. 1.

As shown in FIG. 5, the quench tank 16 includes an inner shell 240, the axis of which is substantially vertical as contrasted with the loading shell 28 and the heating chamber 14. The inner shell of the quench tank 16 is mounted in spaced relation relative to an outer shell 242 that engages the surface on which the furnace 10 is located. The inner and outer shells 240 and 242 define a cooling space 244 therebetween, in which a cooling liquid is circulated for effectively cooling the quench tank as is well known in the art. A dome 246 is mounted on the inner and outer shells 240 and 242 and also includes a cooling space therein for effectively cooling the dome 246. Joined to the outer shell 242 is the connecting section 200 that cooperates therewith to form a part of the cooling jacket in which a cooling liquid is circulated. Also formed on the wall of the inner shell 240 is an opening through which the door frame 202 extends for sealing engagement therein. Mounted on a support 248 located at the bottom of the inner shell 242 is a hydraulic ram 250. Mounted for vertical reciprocating movement in the hydraulic ram 250 is a piston 252 on the uppermost end of which a pulley 254 is secured. Located at the uppermost end of the quench tank 16 are cross beams 256 between which idler pulleys 258 and 260 are rotatably mounted. Fixed to suitable supports and extending substantially the height of the quench tank 16 are spaced track members 262 between which an elevator 264 is mounted for vertical movement. The elevator 264 includes a frame 266 on the lowermost end of which a track section is mounted as defined by spaced track elements 268. The track sections 268 have rollers 269 mounted thereon that receive a work cart 53, the elevator 264 being vertically movable together with the work cart 53 as mounted on the track section to and from the bottom of the quench tank for quenching of the work load 54 as located on the cart 53. For this purpose a cable or chain 270 is provided and extends around the pulley 254 for securement at one end to a fixed point in the quench tank and at the other end to the uppermost end of the elevator 264. Thus, as the hydraulic ram 250 vertically moves the pulley 254 to that position illustrated in phantom in FIG. 8, the elevator 264 with the work cart and load thereon descends to the bottom of the quench tank for immersion of the work cart and the work load thereon within the quench liquid indicated at 272. A motor 274 is mounted at the bottommost end of the quench tank and operates a circulating fan 271 for effectively circulating the quench liquid 272 as indicated by the arrows in FIG. 5 during the quenching operation. As indicated in FIGS. 5 and 8, spring actuated lock elements 275 are mounted on the ends of the elevator adjacent to the track section thereof, the lock elements 275 being urged upwardly on descent of the elevator to form end barriers for capturing the cart on the elevator.

Also mounted on a suitable support in the quench tank is a track section 274 that is located between the door assembly 203 and the elevator 264, the track section 274 directing the work carts 53 from the door frame 202 onto the track section of the elevator 264. A track section 276 is located downstream of the elevator 264 and receives the work cart 54 thereon following the quench operation. A tubular guide member 277 is also mounted on the track section 274 intermediate the track elements and is aligned with the tubular guide member 232. A tubular guide member 278 is further carried by the elevator 264 intermediate the track elements 268 as shown in FIG. 8 and is aligned with the guide members 232 and 274 when the elevator is in the elevated position. A guide member 279 is mounted between the track elements of the track sections 276, all of the aligned guide elements receiving an unload bar and retract spring of an unload mechanism generally indicated at 281. The unload mechanism 281 operates in substantially the same manner as described hereinabove in connection with the loading mechanism and includes a retract spring 282 that is received over a drive pulley 283 similar to drive pulley 114. The drive pulley 283 is mounted for rotation on a drive shaft and is rotatably driven by a drive motor similar to the drive motor 98. A retaining roller 284 engages the drive pulley 283 and is tiltable inwardly toward the quench tank by an unloading tilt assembly that is similar to the loading tilt assembly 128 illustrated in FIG. 13. A secondary retaining roller 286 is located adjacent to the drive pulley 283 but downstream thereof, and urges the drive spring 282 downwardly into a sealed tube 288 that is disposed in a generally vertical position. Secured to the innermost end of the drive spring 282 is an unloading bar 290 on the end of which a pivotal retract element 292 is mounted. The retaining roller 284 is movable by the unloading tilt assembly to depress the unloading bar 290 and retract element 292 in a downward direction during the unloading operation of a cart 53 from the elevator 264 following a quenching operation, wherein the cart is retracted from the elevator track section onto the track section 276. It is understood that the normal operation tension on both springs 94 and 282 is less than the break-away tension thereof, so that the springs never extend in the operation of the load and unload mechanisms.

As further shown in FIG. 5, a door frame 294 is mounted in the inner and outer shells 240 and 242 of the quench tank and has the unload mechanism 281 mounted therein. Mounted on the outermost end of the door frame 294 is a door assembly generally indicated at 296 that includes a door member 298 that controls access through an opening 300 formed in the door frame 294. The door assembly 296 includes the same structure and is moved in the same manner as described above in connection with the door assembly 56. The door member 298 is movable to and from a closed position for vacuum sealing the opening 300 in the door frame 294, and located exteriorly of the door assembly 296 is a track section 302 that forms the discharge station 18 for receiving the carts 53 as they are removed from the furnace following a quench operation.

As previously described, the work carts 53 with the loads 54 thereon are moved through the loading shell 28 and into the heating chamber by a drive spring 94 and the pusher bar 144 to which the pusher element 150 is secured. The cart loaded into the loading shell 28 is moved forwardly by the drive spring 94 until it engages the next cart in the heating chamber. Thus it is the last cart loaded that provides for successive movement of the previously loaded carts. In this connection the last cart loaded is conveyed into the heating chamber 14 by the drive spring 94 and the pusher bar 144, the drive spring and pusher bar extending through the guide members 152 and 229 during the transfer movement thereof. However the work carts 53 are discharged from the heating chamber 14 by extending the puller bar 290 and unload spring 282 through the guide members 276, 278, 277 and 233 into the heating chamber 14. The retract element 292 pivots upon engagement with a cross bar of the work cart and is movable therebehind, whereupon it latches behind the cart cross bar. A retract movement of the drive spring then pulls the forwardmost cart in the heating chamber by the open thermal door 222 through the door frame 202 and by the open door assembly 203 for positioning on the track section of the elevator 264. At this point the tilt mechanism for the spring 282 and puller bar 290 is operated to depress the puller bar and move the retract element 292 out of engagement with the cart cross bar. Continued rearward movement of the spring 282 by its drive motor retracts the puller bar from the elevator which is now free to descend into the quench liquid. Following the quench operation and elevation of the work load to the upper position, the unload mechanism again operates to advance the puller bar 290 and the retract element 292 toward the cart until the retract element once more engages the cross bar of the work cart. A reverse movement of the retract spring 282 pulls the cart from the elevator onto the track section in the door frame 294 for unloading onto the track section 302 at the discharge station 18.

Figure 14:
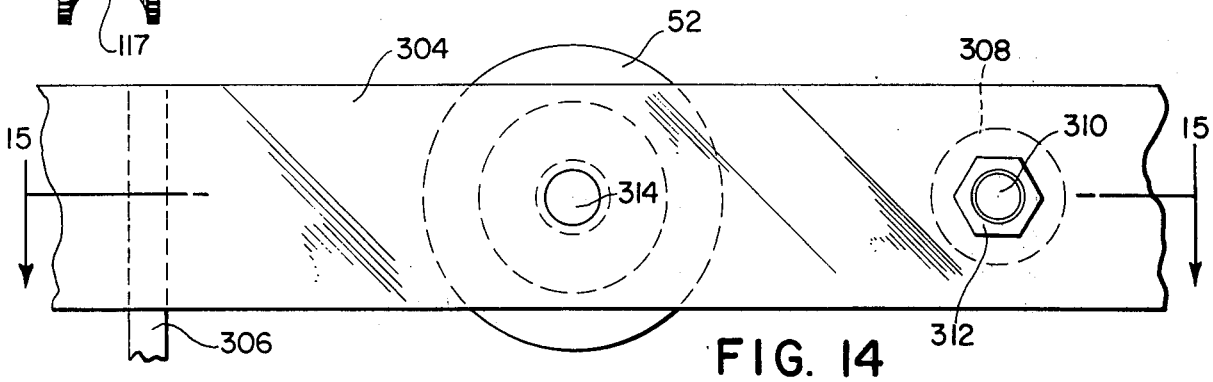
FIG. 14 is a side elevational view of a portion of the heating chamber track on which work carts are transferred.
Figure 15:
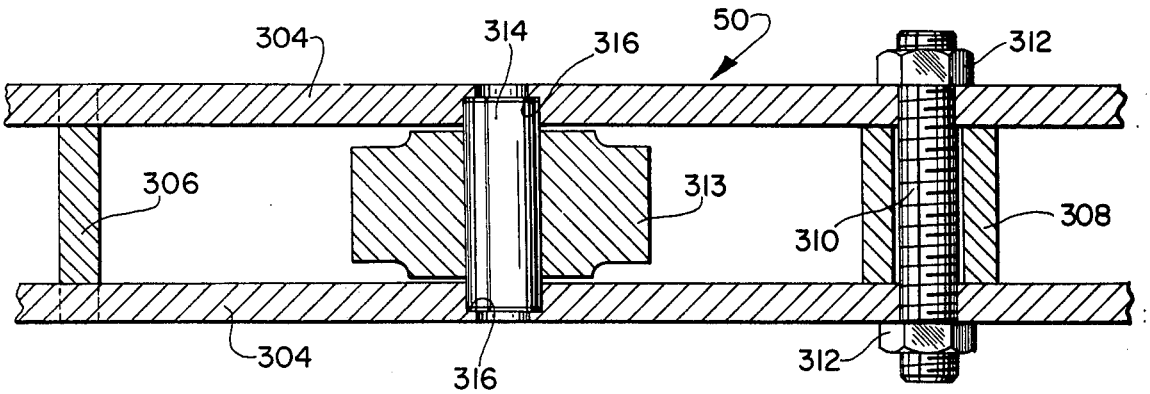
FIG. 15 is a sectional view taken along line 15—15 in FIG. 14.

As described hereinabove, the various track sections as located at the stations of the furnace are all constructed substantially similar; and, in order to illustrate the construction of the track sections and the rollers as mounted thereon, reference is made to FIGS. 14 and 15. In this connection, reference is made to the track section 230 and the rollers as mounted thereon, since this track section is located in the heating chamber 14 and is constructed of special materials to withstand the high temperatures experienced during the heat treating operation. The track section 230 includes pairs of spaced-apart members 304 which are supported by a series of notched pier supports 306. The material from which the track members 304 and pier supports 306 are constructed is preferably molybdenum, since this material is capable of withstanding relatively high temperatures that are experienced during the heat treating operation of the furnace. Spacing the track members 304 apart are a plurality of spacer elements 308 through which a bolt 310 extends, the ends of the bolt 310 projecting through suitable openings formed in the members 304 and receiving nuts 312 thereon. The spacers 308, bolts 310 and nuts 312 are also formed of molybdenum material. Rollers 313 which are mounted between the members 304 are formed of a graphite material and are thus heat resistent and are rotatably mounted on tungsten pins 314. In order to fix the pins 314 in the members 304, the members are recessed as indicated at 316, the ends of the pins 314 being received therein in frictional relation. As previously described, the side frame of the carts 53 are received on the rollers 313, the rollers 313 having free rotation on the pins 314 thereby providing for movement of the carts 53 on the track section 230 through the heating station 14. Track section 232 which is also located in the heating chamber 14 would be constructed similarly to track section 230, and those track sections not exposed to excessively high temperatures would also be constructed similarly, but the materials from which the component parts of these latter track sections are constructed is mild steel. Further, the rollers of these latter track sections are provided with interior bearings to promote the rotation thereof.

Figure 18:
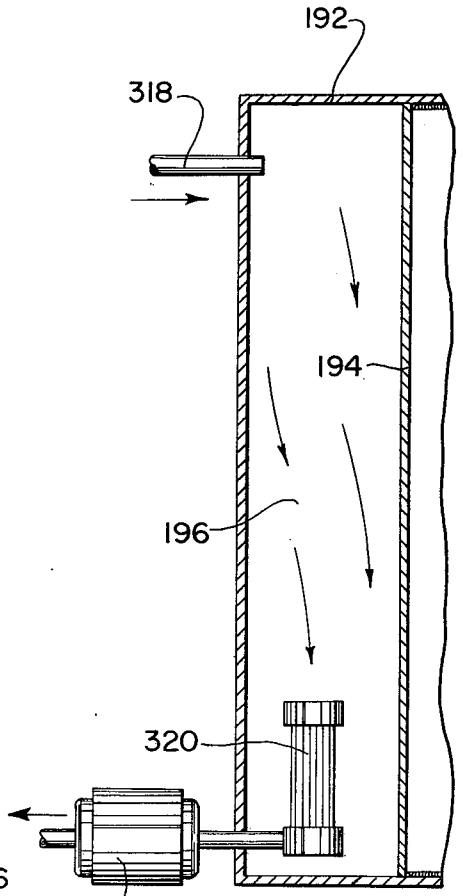
FIG. 18 is a sectional view taken along line 18—18 in FIG. 7 and illustrating the hydraulic fluid cooling system.

As previously described, a chamber 196 is formed in the outer shell 192 of the heating chamber 14 by locating a plate 194 within the outer shell 192 in angular relation thereto. The chamber 196 which is further illustrated in FIG. 18 is provided for circulation of the hydraulic fluid therein that is used to operate the various hydraulic motors of the system. An inlet 318 that communicates with the hydraulic system extends into the chamber 196 and directs the hydraulic fluid therein. A filter 320 is also located in the chamber 196 and communicates with a suction pump 322, the suction pump 322 directing the hydraulic fluid to the hydraulic system. It is seen that the cooling chamber as defined between the inner shell 190 and outer shell 192 of the heating chamber 14 is effective to withdraw heat from the hydraulic fluid that circulates through the chamber 196. The cooling chamber 196 thus avoids the use of an external heat exchanger unit for the hydraulic system and that would normally be employed in furnaces of the type embodied in the subject invention.

In the operation of the device, it is understood that the loading shell 28 at the loading station 12, the heating chamber 14 and the quench station 16 are all operated under vacuum conditions during various phases of the operation of the furnace and for this purpose communicate with a vacuum pump indicated at 324 in FIG. 1. A vacuum line 326 is interconnected to vacuum lines 328, 333 and 332 for evacuating the various stations of the furnace at the required intervals. Although not shown, conventional valves are utilized to control the evacuation of the stations, and the usual purge lines are also provided for the loading and quench stations for introducing an atmosphere therein.

OPERATION

In describing the operation of the furnace 10, it will be assumed that the heating chamber 14 and the quench station 16 are normally operating and have been evacuated to a predetermined vacuum pressure. In this connection the heating chamber has been evacuated to less than 500 microns and the quench station has been backfilled with nitrogen and is operating at 10 inches of mercury vacuum. All of the doors are closed and sealed, and the pressure in the loading shell is atmospheric. It is further assumed that a load is on the elevator 264 and is disposed in the quench liquid undergoing a quench cycle. A load is in the loading vestibule within the shell 28 and three loads are disposed end-to-end in the heating chamber 14. A load is also located on the loading platform 42 ready for entry into the loading chamber. Maintaining the conditions as described, the elevator 264 ascends with the load thereon to the unload position. The quench station 16 is then purged with nitrogen and brought to atmospheric conditions, whereafter the door assembly 296 is operated to open the door member 300. The quench load now completely heat treated is manually withdrawn onto the track sections 302 at the discharge station for removal. Thereafter, the door assembly 296 closes the door member 298 and the quench tank is evacuated to approximately 500 microns for removing contaminants that resulted when the last load was quenched and then removed from the quench station. Thereafter the quench tank is backfilled with nitrogen to 10 inches hg vac. and maintained thereat for a predetermined soak period. The heating chamber 14 is then backfilled with nitrogen to 10 inches hg vac. With both the heating chamber and quench station at 10 inches hg vac., the door assembly 203 is operated to open the door member 204 which simultaneously opens the thermal door 222. The unload mechanism is operated to remove the next load onto the elevator 264 which immediately descends into the quench liquid to begin the quench cycle. The door assembly 203 seals the door member 204 and the thermal door 222 is also closed. The heating chamber is then again evacuated to approximately 500 microns.

In preparation of moving the load in the loading vestibule into the heating chamber, the loading shell 28 is evacuated to 500 microns and the door assembly 186 is then operated to open the door member 188 which simultaneously opens the thermal door 220. The load mechanism is operated to transfer the load from the loading vestibule into the heating chamber, the transfer operation stepping the two remaining loads in the heating chamber forwardly. The door assembly 186 then seals the door member 188, which closes the thermal door 220, and the loading shell 28 is backfilled with nitrogen to 5 inches hg vac. Thereafter the loading shell is brought to atmospheric condition and the loading door 56 is operated to open the door member 58 for entry of the load on the platform into the loading shell 28. The door member 58 is then closed and the cycle is repeated.

It is understood that the vacuum pressures referred to in the description of the operating cycle hereinabove are only representative of one cycle of operation, and the operating conditions employed will be predetermined by the heat treating requirements of the work load. The temperature in the heating chamber is also varied in accordance with the work load to be heat treated and time intervals for the cycle will again be predetermined in accordance with the heat treating requirements.

Because of the modular construction of the loading shell 28 and the connecting sections 38 and 200, it is also contemplated to include an atmosphere cooling chamber in place of the liquid quench station or in conjunction therewith. Various heat treating operations can be carried out by the furnace and carburizing, sintering, brazing and other conventional procedures may be accomplished by the furnace without any alteration of the structure thereof.

It is also understood that all of the operations of the various motors that control the load and unload mechanisms, the door assemblies, the evacuation and purging of the loading shell 28 and quench station 16, and movement of the quench elevator are all automatic and are timed in accordance with the characteristics of the metal parts being heat treated. An appropriate console is located adjacent to the furnace 10 and is electrically connected to the various operating mechanisms so that the system is preset and upon operation of the starting motor the cycle begins and is carried out automatically. It is understood of course that loading of a cart into the loading shell 28 and withdrawal at the discharge station is carried out manually, although this also may be accomplished automatically if required.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A vacuum furnace for continuously introducing and processing work parts through a heating chamber of the furnace for the heat treatment thereof without breaking the vacuum in said heating chamber, comprising a housing in which said heating chamber is located, a loading station including a loading chamber located forwardly of said heating chamber for receiving work parts therein prior to transfer to said heating chamber, a cooling station located rearwardly of said heating chamber and communicating with a discharge station located at the rear of said housing, a first door assembly located at the forward end of said housing for sealing said loading chamber from atmosphere, a second door assembly located between said loading chamber and heating chamber for sealing communication therebetween, a third door assembly for sealing said cooling station from atmosphere, and a fourth door assembly sealing communication between said heating chamber and said cooling station, a series of tracks located in spaced relation at said loading station, heating chamber, cooling station and discharge station, a cart on which said work parts are carried for travel on said tracks, a first transfer means for moving said work cart from said loading station into said heating chamber at predetermined intervals, and a second transfer means operated independently of said first transfer means for removing said work cart from said heating chamber for transfer to said cooling station and for transfer to said discharge station, said first transfer means including an elongated flexible spring that is mounted independent of the door assembly located adjacent thereto and on the end of which a transfer element is secured, gear means engaging said spring for producing linear movement thereof, means for rotating said gear means, and means for urging said spring into intimate engagement with said gear means for effecting a positive drive therebetween.

2. A vacuum furnace as claimed in claim 1, said urging means including a roller that is contoured to snugly engage said spring for urging it into intimate contact with said gear means.

3. A vacuum furnace as claimed in claim 1, a detent secured to the outermost end of said transfer element, a tubular guide member located at said loading station in alignment with the transfer element that is joined to the spring extending therein, said tubular member receiving the transfer element located at said loading station during a transfer movement of said cart, said detent being engageable with said cart and effecting the movement thereof upon linear movement of said spring.

4. A vacuum furnace as claimed in claim 3, said member having a longitudinally extending slot formed therein that receives said detent during the transfer operation of said cart.

5. A vacuum furnace as claimed in claim 1, means for reversing rotation of said rotating means in accordance with a predetermined linear movement of said spring, wherein the spring is retracted to its original position in preparation for transferring another cart to said heating chamber.

6. A vacuum furnace as claimed in claim 1, said transfer means including a second elongated flexible spring that is extendible into said cooling station and heating chamber, second gear means engaging said second spring for effecting linear movement thereof, second rotating means driving said second gear means for producing the linear movement of said second spring, said second rotating means being operable following a heating operation for pulling a cart on which work parts are located from said heating chamber to said cooling station and after the cooling operation to said unload station.

7. A vacuum furnace as claimed in claim 1, said cooling station including a quench tank having a liquid receiving portion located below the track therein, an elevator on which a track section is mounted for receiving a cart thereon, means for securing said cart on said track section in response to descent of said elevator into said liquid receiving portion of said quench tank, hydraulic operating means interconnected to said elevator for producing vertical movement thereof, and means in said liquid receiving portion for circulation of the quench liquid therein during a quenching operation.

8. A vacuum furnace as claimed in claim 7, a chain interconnecting said elevator to said hydraulic operating means, said chain being fixed at one end to said housing and being secured at the other end to the top of said elevator, wherein vertical movement of a ram in said hydraulic operating means produces a corresponding movement of said elevator.

9. A vacuum furnace as claimed in claim 1, each of said tracks including opposed pairs of spaced members, spacers interposed between said spaced members for locating them in their spaced apart position, and a plurality of wheel assemblies mounted on said track members intermediate said spacers, each of said wheel assemblies including a roller that is mounted on a pin extending through the axis thereof, said pins being received in opposed recesses in the opposed members in fixed relation, thereby mounting the rollers for rotation relative to said members.

10. A vacuum furnace for heat treating work parts in a subatmospheric environment in a heating chamber of said furnace, comprising a housing in which said heating chamber is located, a loading station located forwardly of said heating chamber for receiving work parts therein prior to the transfer of said work parts to said heating chamber, a cooling station communicating with said heating chamber, a discharge station communicating with said cooling station, means for transferring said work parts from said loading station and into said heating chamber and for transferring said work parts from said heating chamber to said cooling and discharge stations, and a plurality of door assemblies for sealing communication between adjacent stations during the processing of said work parts in said furnace, at least one of said door assemblies including a fixed frame having an exterior sealing surface and defining an opening for communication with an interior zone, a plate-like door member mounted for movement relative to said frame and having an inside and an outside surface, a sealing member mounted on the inside surface of said door member adjacent to the marginal edges thereof, so that said sealing member positively engages the sealing surface of said frame when the door member is in the closed position on said frame for sealing said door member thereto, and means operatively connected to the other surface of said door member for simultaneously moving said door member from the closed sealed position in a vertical and rotating motion to an open upper horizontal position, wherein said inside surface of said door member and said sealing member mounted thereon face upwardly and are remote from said interior zone, and said outside surface of said door member faces downwardly and defines a buffer for said sealing members against high temperatures emanating from said interior zone.

11. A vacuum furnace as claimed in claim 10, said moving means including a drive member mounted for rotation on said frame, link members interconnecting said drive member to said door member, gear means interconnecting said drive member to said door member, and operating means for rotating said drive member to lift and pivot said door member from the sealed to the open position.

12. A vacuum furnace as claimed in claim 11, a rod rotatably mounted on the outside surface of said door member, said link members being secured to said rod, wherein said rod and door member are movable with said link members upon rotation of said drive member, said gear means including a first gear mounted on said drive member and fixed relative thereto and a second gear mounted on said rod and fixed relative thereto, and a sprocket chain interconnecting said first and second gears and being operable to produce the pivotal movement of the door member as the door member is lifted by said drive member and link members joined thereto.

13. A vacuum furnace as claimed in claim 12, the ratio of said first gear relative to said second gear being 2:1, said first gear being secured to said housing and said second gear being secured to said door member, wherein rotation of said drive member not only lifts but pivots the door member as it moves from the closed to the open position.

14. A drive assembly for moving a work cart through the interior of a heat treating furnace, comprising an elongated flexible coil spring, a pulley having an annular groove formed therein in which teeth are disposed in pitched, spaced relation and generally parallel to the axis of said pulley for receiving the coils of said spring in driving relation, means for rotating said pulley for effecting a longitudinal movement of said spring, a pivotally mounted roller having an annular groove that snugly engages said spring for urging said spring into intimate contact with said pulley, and a push member joined to the outermost end of said spring and engaging said work cart for producing a movement thereof as said spring is moved longitudinally, the teeth as formed in the groove in said pulley being located at the lowermost portion thereof, wherein the spring is prevented from riding out of the groove during the longitudinal movement of the spring.

15. A vacuum furnace for continuously introducing and processing work parts through a heating chamber of the furnace for the heat treatment thereof without breaking the vacuum in said heating chamber, comprising a housing in which said heating chamber is located, a loading station including a loading chamber located forwardly of said heating chamber for receiving work parts therein prior to transfer to said heating chamber, a cooling station located rearwardly of said heating chamber and communicating with a discharge station located at the rear of said housing, a first door assembly located at the forward end of said housing for sealing said loading chamber from atmosphere, a second door assembly located between said loading chamber and heating chamber for sealing communication therebetween, a third door assembly for sealing said cooling station from atmosphere, and a fourth door assembly sealing communication between said heating chamber and said cooling station, a series of tracks located in spaced relation at said loading station, heating chamber, cooling station and discharge station, a cart on which said work parts are carried for travel on said tracks, a first transfer means for moving said work cart from said loading station into said heating chamber at predetermined intervals, and a second transfer means operated independently of said first transfer means for removing said work cart from said heating chamber for transfer to said cooling station and for transfer to said discharge station, said transfer means including an elongated flexible spring on the end of which a transfer element is secured, gear means engaging said spring for producing linear movement thereof, means for rotating said gear means, and means for urging said spring into intimate engagement with said gear means for effecting a positive drive therebetween, said urging means including a roller that is contoured to snugly engage said spring for urging it into intimate contact with said gear means, means for pivotally moving said roller downwardly against said spring to temporarily retain said spring in a depressed position relative to said gear means so as to enable said cart to move into said loading chamber forwardly of said detent prior to the transfer operation of said cart into said heating station, said spring being releasable to locate said detent in engagement with a portion of said cart, wherein said transfer element and spring joined thereto are movable in a linear direction for moving said cart.

16. A vacuum furnace for continuously introducing and processing work parts through a heating chamber of the furnace for the heat treatment thereof without breaking the vacuum in said heating chamber, comprising a housing in which said heating chamber is located, a loading station including a loading chamber located forwardly of said heating chamber for receiving work parts therein prior to transfer to said heating chamber, a cooling station located rearwardly of said heating chamber and communicating with a discharge station located at the rear of said housing, a first door assembly located at the forward end of said housing for sealing and loading chamber from atmosphere, a second door assembly located between said loading chamber and heating chamber for sealing communication therebetween, a third door assembly for sealing said cooling station from atmosphere, and a fourth door assembly sealing communication between said heating chamber and said cooling station, a series of tracks located in spaced relation at said loading station, heating chamber, cooling station and discharge station, a cart on which said work parts are carried for travel on said tracks, a first transfer means for moving said work cart from said loading station into said heating chamber at predetermined intervals, and a second transfer means operated independently of said first transfer means for removing said work cart from said heating chamber for transfer to said cooling station and for transfer to said discharge station, said first transfer means including an elongated flexible spring on the end of which a transfer element is secured, gear means engaging said spring for producing linear movement thereof, means for rotating said gear means, and means for urging said spring into intimate engagement with said gear means for effecting a positive drive therebetween, means for reversing rotation of said rotating means in accordance with a predetermined linear movement of said spring, wherein the spring is retracted to its original position in preparation for transferring another cart to said heating chamber, said reversing means including a switch electrically interconnected to said rotating means, an elongated rod engageable with said switch means and being responsive to linear movement of the spring that transfers the cart to said heating chamber to reverse the operation of said rotating means, wherein said transfer element is retracted in preparation for the next cart feeding operation.

17. A vacuum furnace as claimed in claim 16, an elongated tubular housing for receiving a spring therein, said tubular housing extending from the loading station below and in parallel relation to said elongated rod, the spring in said tubular housing being movable therein during a transfer operation and being operable to produce the reverse operation of said rotating means.

18. A vacuum furnace for continuously introducing and processing work parts through a heating chamber of the furnace for the heat treatment thereof without breaking the vacuum in said heating chamber, comprising a housing in which said heating chamber is located, a loading station including a loading chamber located forwardly of said heating chamber for receiving work parts therein prior to transfer to said heating chamber, a cooling station located rearwardly of said heating chamber and communicating with a discharge station located at the rear of said housing, a first door assembly located at the forward end of said housing for sealing said loading chamber from atmosphere, a second door assembly located between said loading chamber and heating chamber for sealing communication therebetween, a third door assembly for sealing said cooling station from atmosphere, and a fourth door assembly sealing communication between said heating chamber and said cooling station, a series of tracks located in spaced relation at said loading station, heating chamber, cooling station and discharge station, a cart on which said work parts are carried for travel on said tracks, a first transfer means for moving said work cart from said loading station into said heating chamber at predetermined intervals, and a second transfer means operated independently of said first transfer means for removing said work cart from said heating chamber for transfer to said cooling station and for transfer to said discharge station, said housing including an inner tubular shell and an outer shell having a configuration that is rectangular in cross section, the inner shell being located within the outer shell, the outer shell defining a cooling jacket around the inner shell, wherein a cooling fluid is circulated therebetween, a corner of the space as defined by said inner and outer shells having a wall extending longitudinally therein to define a hydraulic fluid cooling space, and means for continuously circulating hydraulic fluid used to operate various motors associated with said furnace through said cooling space in heat exchange relation therewith.

* * * * *